US007448597B2

(12) United States Patent
Jacobson et al.

(10) Patent No.: US 7,448,597 B2
(45) Date of Patent: Nov. 11, 2008

(54) POWERED PERSONNEL ASCENDER

(75) Inventors: Michael D. Jacobson, Dayton, NV (US); Tim Walter, Carson City, NV (US)

(73) Assignee: Quoin International, Inc., Carson City, NV (US)

( * ) Notice: Subject to any disclaimer, the term of this patent is extended or adjusted under 35 U.S.C. 154(b) by 0 days.

(21) Appl. No.: 11/772,659

(22) Filed: Jul. 2, 2007

(65) Prior Publication Data

US 2008/0157042 A1 Jul. 3, 2008

Related U.S. Application Data

(63) Continuation of application No. PCT/US2006/000220, filed on Jan. 4, 2006, and a continuation of application No. PCT/US2005/015954, filed on May 6, 2005.

(60) Provisional application No. 60/696,382, filed on Jul. 1, 2005, provisional application No. 60/656,605, filed on Feb. 25, 2005, provisional application No. 60/642,270, filed on Jan. 6, 2005.

(51) Int. Cl.
*B66D 1/50* (2006.01)

(52) U.S. Cl. ..... 254/274; 254/333; 254/371; 254/383

(58) Field of Classification Search ..... 254/274, 254/278, 333, 371, 383
See application file for complete search history.

(56) References Cited

U.S. PATENT DOCUMENTS 3,608,864 A * 9/1971 Dargitz et al. ..... 254/274
3,645,503 A * 2/1972 Doerfling ..... 242/157.1
3,664,205 A 5/1972 Luras
3,680,839 A 8/1972 Mattinson
3,936,622 A * 2/1976 McElroy ..... 200/85 R
3,984,083 A * 10/1976 McElroy ..... 254/342
4,634,102 A * 1/1987 Appling et al. ..... 254/278
4,811,669 A 3/1989 Dahlman
5,280,879 A * 1/1994 Kreuter ..... 254/333
5,996,971 A * 12/1999 Crouse ..... 254/371
6,059,266 A 5/2000 Ascherin et al.
6,283,455 B1 9/2001 Ascherin et al.
7,028,988 B2 * 4/2006 Scott ..... 254/277
7,261,278 B2 * 8/2007 Ball et al. ..... 254/325
7,364,136 B2 * 4/2008 Hossler ..... 254/278
2006/0231812 A1 * 10/2006 Ziech et al. ..... 254/278

* cited by examiner

*Primary Examiner*—Emmanuel M Marcelo
(74) *Attorney, Agent, or Firm*—John P. O'Banion

(57) ABSTRACT

A powered rope ascender that supports a person or a load while ascending a vertical rope. The rope ascender has a motor driven capstan drum that engages the rope. A pinch roller grips the rope against the capstan drum. A load limiting assembly releases the grip by the pinch roller when the load supported by the ascender exceeds a predetermined amount. A centrifugal clutch reduces starting torque required by the motor and the outer drum of the centrifugal clutch interacts with a brake to hold position on the rope. For heavy loads a motion activated brake is used. Hand controls provide a free-wheeling, a braking and an ascending mode of operation. A harmonic drive or planetary reduction gears provide speed reduction from the motor to the capstan drum. The powered rope ascender can be threaded on the rope without access to a rope end.

42 Claims, 20 Drawing Sheets

POWERED PERSONNEL ASCENDER

CROSS-REFERENCE TO RELATED APPLICATIONS

This application claims priority from, and is a 35 U.S.C. §111(a) continuation of, co-pending PCT international application Ser. No. PCT/US2006/000220, filed on Jan. 4, 2006, incorporated herein by reference in its entirety, which claims priority from U.S. provisional application Ser. No. 60/696,382, filed on Jul. 1, 2005, incorporated herein by reference in its entirety, PCT International Application Serial No. PCT/US2005/015954, filed on May 6, 2005, incorporated herein by reference in its entirety, U.S. provisional application Ser. No. 60/656,605, filed on Feb. 25, 2005, incorporated herein by reference in its entirety, and U.S. provisional application Ser. No. 60/642,270 filed on Jan. 6, 2005, incorporated herein by reference in its entirety.

This application is related to PCT International Publication No. WO 2006/074250 A2, published on Jul. 13, 2006, incorporated herein by reference in its entirety, and to PCT International Publication No. WO 2006/073462 A2, published on Jul. 13, 2006, incorporated herein by reference in its entirety, and republished as WO 2006/073462 A3 on Jun. 7, 2007, incorporated herein by reference in its entirety.

STATEMENT REGARDING FEDERALLY SPONSORED RESEARCH OR DEVELOPMENT

This invention was made with Government support under Grant No. DAAH01-03-C-R164, awarded by the Defense Advanced Research Program Agency (DARPA) and Grant No. FA 8651-04-C-0334, awarded by DARPA. The Government has certain rights in this invention.

INCORPORATION-BY-REFERENCE OF MATERIAL SUBMITTED ON A COMPACT DISC

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. §1.14.

BACKGROUND OF THE INVENTION

1. Field of the Invention

This invention pertains generally to rope climbing devices, and more particularly to powered rope climbing devices or powered ascenders.

2. Description of Related Art

Climbing devices are used to enable a person to ascend or descend a rope or cable. There are many examples where a climbing device is needed that can be operated by the person ascending the rope, such as mountain climbing, caving, tree trimming, rescue operations and military operations. Industrial uses of a climbing device may include scaling tall structures, towers, poles, mine shafts or bridge works for servicing, cleaning, window washing, painting, etc.

Manual lifting devices, also known as ascenders, are configured to grip a vertical tensioned rope when load is present and to slide when the load is released. Typically, an individual must be capable of repetitively lifting their own weight on the manual ascender when climbing with these devices.

Powered personal lifting devices assist personnel in scaling vertical surfaces. Motorized winches are used to raise or lower personnel on platforms or harnesses attached to ropes. A winch must be anchored to a solid platform above the load or use pulleys coupled to the platform to hoist the load. Further, a winch winds the rope or cable on a spool which limits the length and weight of rope that can be used. Hoists, usually with compound pulleys or reducing gears are used to raise or lower individuals or platforms and must be suspended from a secure support point such as a tripod, beam or bridge crane. Typically a winch or hoist requires at least a second person to operate or control the device in order for a first person to safely ascend a rope.

Portable, climber operated winches are limited by bulky power delivery systems and associated weight of the spool.

Safety is a paramount concern when a person is ascending a rope. Failure of a component that results in a rapid descent or fall will result in injury or death. Existing ascenders typically have cams, jam cleats or other braking devices that will engage if a sudden or rapid descent is detected. These devices can cause a sudden stop with resulting injury or equipment damage. A lightweight powered rope ascender with means to brake during ascent, to hold a position on a rope and to descend in a controlled manner is needed.

BRIEF SUMMARY OF THE INVENTION

A powered rope ascender capable of supporting an operator has a motor driven capstan drum to engage the rope. A tension roller forces a pinch roller to grip the rope on the capstan. A centrifugal clutch reduces the starting torque of the motor and services as a brake drum for an integrated brake. A harmonic drive is used to reduce the rpm's of the capstan relative to the motor. A spring loaded load limiting assembly reduces the grip force by the pinch roller when the load supported by the ascender exceeds a predetermined amount and provides for rope slippage during dynamic loading from starting and stopping ascent and descent. The powered rope ascender can be threaded on a rope without access to a rope end.

In context of this invention, a wrap of rope is defined as either a closed loop of rope on the capstan drum or an open loop of rope contacting the capstan drum and contacting another roller such as a tension roller, pinch roller and/or an idler roller.

An embodiment of the invention comprises a base plate, means for engaging a rope, where the means for engaging a rope is coupled to the base plate, where the means for engaging a rope is configured to grip the rope, a motor coupled to base plate, where the motor is adapted to propel the means for engaging a rope relative to the rope, and means for limiting load, where the means for limiting load is coupled to the base plate, where the means for limiting load is configured to be coupled to a load, and where the means for limiting load is configured to reduce the grip on the rope by the means for engaging a rope when the load coupled to the means for limiting load exceeds a predetermined amount.

An aspect of the invention is a motor selected from the group consisting of a DC motor, an AC motor, a brushless motor, a compressed gas turbine, and an internal combustion engine.

A further aspect of the invention is where the means for engaging a rope comprises, a capstan drum coupled to the motor, a tension roller bracket having distal and proximal ends and a pivot point between the distal and proximal ends, the tension roller bracket coupled to the base plate at the pivot point, a tension roller coupled to the distal end of the tension roller bracket, and a pinch roller coupled to the proximal end of the tension roller bracket, where the pinch roller is positioned to contact the capstan drum.

A still further aspect of the invention is where when a load is supported on the means for limiting load, the tension roller is configured to contact an upper region of rope that has at least one wrap of rope on the capstan drum, and where the pinch roller is configured to simultaneously apply a gripping force against the at least one wrap of rope on the capstan drum.

A yet further aspect of the invention is where the means for engaging a rope comprises a capstan drum coupled to the motor, a pinch roller coupled to the base plate and further coupled to the means for limiting load, the pinch roller having a closed position and an open position, where in the closed position, the pinch roller is adapted to grip at least one wrap of rope on the capstan drum, and where in the open position, the pinch roller does not contact the at least one wrap of rope on the capstan drum.

Another aspect of the invention is where the means for engaging a rope further comprises an idler roller coupled to the base plate, where the idler roller is positioned adjacent to the capstan drum, where the capstan drum has a plurality of grooves, where the idler roller has at least one groove, and where the idler roller is adapted to guide the at least one wrap of rope around the capstan drum.

A further aspect of the invention is a harmonic drive coupled between the capstan drum and the motor, where the harmonic drive is adapted to reduce the rotation speed of the capstan drum relative to the rotation speed of the motor, and where the capstan drum can back drive the harmonic drive.

A still further aspect of the invention is a brake coupled to the base plate, a brake drum coupled between the harmonic drive and the motor, where the brake drum has an inner and outer drum surface, and where the brake is adapted to engage the outer drum surface.

Another aspect of the invention is a centrifugal clutch mounted in the brake drum, where the centrifugal clutch is coupled to the motor, where the centrifugal clutch is adapted to engage the inner drum surface, and where the centrifugal clutch is adapted to reduce the starting torque required by the motor.

A further aspect of the invention is a trigger coupled to the base plate, the trigger linked to the brake, the trigger having first and second positions, and a motor controller linked to the trigger, the motor controller adapted to energize the motor, where when the trigger is in the first position, the brake is engaged with the outer drum surface and the motor is not energized by the motor controller, and where when the trigger is in the second position, the brake is disengaged from the outer drum surface and the motor is energized by the motor controller.

A still further aspect of the invention is a receiver connected to the motor controller, where the receiver is adapted to receive control signals to control the motor controller, and a remote transmitter adapted to send control signals to the receiver.

Another aspect of the invention is a palm interlock coupled to the base plate, the palm interlock adapted to react to palm pressure by an operator, where the palm interlock is adapted to lock the trigger in the first position when no palm pressure is applied by the operator, and where the palm interlock is adapted to allow the trigger to move to the second position when palm pressure is applied to the palm interlock by the operator.

Another aspect of the invention is where the trigger has a third position, and when the trigger is in the third position, the brake is disengaged from the outer clutch drum surface and the motor is not energized by the motor controller.

A further aspect of the invention comprises a palm interlock coupled to the base plate, the palm interlock adapted to react to palm pressure by an operator, where the palm interlock is adapted to lock the trigger in the first position when no palm pressure is applied by the operator, and where the palm interlock is adapted to allow the trigger to move from the first position to the third and the second positions when palm pressure is applied to the palm interlock by the operator.

A still further aspect of the invention comprises a rotating yoke coupled to the motor, a motion activated brake coupled between the rotating yoke and the capstan drum, where the motion activated brake has a drive state and a brake state, where the motion activated brake is in the drive state and rotates the capstan drum when the rotating yoke is rotating, and where the motion activated brake is in the brake state and prevents the capstan drum from rotating when the rotating yoke is stationary.

Another aspect of the invention is a trigger coupled to the base plate, the trigger having first and second positions, and a motor controller linked to the trigger, the motor controller adapted to energize the motor, where when the trigger is in the first position, the motor is not energized by the motor controller and the motion activated brake is in the brake state, and where when the trigger is in the second position, the motor is energized by the motor controller and the brake is in the drive state.

A further aspect of the invention is a motor enclosure coupled to the base plate adapted to enclose the motor, a battery electrically connected to the motor, and a battery enclosure coupled to the base plate adapted to enclose the battery, where the battery cannot be electrically disconnected from the motor when the motor is enclosed in the motor enclosure and the battery is enclosed in the battery enclosure.

A still further aspect of the invention is where the means for limiting load comprises a tension arm having distal and proximal ends, the proximal end coupled to the means for engaging a rope, where the distal end of the tension arm is adapted to move in a first direction, where the means for engaging a rope is adapted to reduce the grip on the rope when the distal end of the tension arm is moved in the first direction, a load bracket having a pivot dowel, a support dowel and a load aperture, the load bracket coupled to the base plate at the pivot dowel, a spring loaded support assembly coupled to the base plate, the spring loaded support assembly adapted to support the load bracket at the support dowel, where the spring loaded support assembly is adapted to react with the distal end of the tension arm, and where the spring loaded support assembly is adapted to move the distal end of the tension arm in the first direction thereby causing the means for engaging a rope to reduce the grip on the rope when the load supported in the load aperture exceeds a predetermined amount.

Another aspect of the invention is where the spring loaded support assembly comprises a pivot bracket having a pivot end and a roller support platform, the pivot end coupled to the base plate, a spring support clevis having a clevis fork and a support rod, the clevis fork coupled to the base plate, where the spring support clevis is positioned under the roller support platform, a spring retainer having a distal end and a proximal end, the distal end having a bore adapted to fit over the support rod, the proximal end of the spring retainer having a flange adapted to fit under the roller support platform, a compression spring adapted to fit between the support clevis and the flange of the spring retainer, a slot in the roller support platform, a platen coupled to the flange of the spring retainer, where the platen is adapted to extend through the slot in the roller support platform, and a roller coupled to the support dowel of the load bracket, where the roller is adapted to be supported on the platen when the load supported in the load aperture is less than or equal to the predetermined amount, and where the roller is adapted to react with the roller support bracket thereby moving the distal end of the tension arm in the first direction causing the means for engaging a rope to reduce the grip on the rope when the load supported in the load aperture exceeds the predetermined amount.

A further aspect of the invention is where the roller support bracket is adjustable with respect to reaction with the distal end of the tension arm.

Another embodiment of the invention is a base plate, a motor coupled to the base plate, a capstan drum coupled to the motor, where the motor is adapted to rotate the capstan drum, where the capstan drum is adapted to receive at least one wrap of rope, an upper rope guide coupled to the base plate and adapted to guide a rope to the capstan drum, a pinch roller coupled to the base plate, where the pinch roller is configured to apply a gripping force against the at least one wrap of rope on the capstan drum, and means for limiting load, the means for limiting load coupled to the base plate, where the means for limiting load is further adapted to couple to the load, where the means for limiting load is adapted to react with the pinch roller, and where the means for limiting load is configured to reduce the gripping force by the pinch roller on the at least one wrap of rope on the capstan drum when the load exceeds a predetermined amount.

A still further aspect of the invention is a tension roller bracket having distal and proximal ends and a pivot point between the distal and proximal ends, where the pinch roller is coupled to the proximal end of the tension roller bracket, where the tension roller bracket is coupled to the base plate at the pivot point, a tension roller coupled to the distal end of the tension roller bracket, where when a load is supported on the means for limiting load, the tension roller is configured to contact an upper region of rope between the upper rope guide and the capstan drum, and where the pinch roller is configured to simultaneously apply a gripping force against the at least one wrap of rope on the capstan drum.

Another aspect of the invention is where the pinch roller has a closed position and an open position, where in the closed position, the pinch roller is adapted to grip the at least wrap of rope on the capstan drum, and where in the open position, the pinch roller does not contact the at least one wrap of rope on the capstan drum.

A further aspect of the invention is a brake coupled to the base plate, a brake drum coupled between the capstan drum and the motor, where the brake drum has an inner and outer drum surface, where the brake is adapted to engage the outer drum surface, a centrifugal clutch mounted in the brake drum, where the centrifugal clutch is coupled to the motor, where the centrifugal clutch is adapted to engage the inner drum surface, and where the centrifugal clutch is adapted to reduce the starting torque required by the motor.

A still further aspect of the invention is the trigger having a third position, where when the trigger is in the third position, the brake is disengaged from the outer drum surface and the motor is not energized by the motor controller, a palm interlock coupled to the base plate, the palm interlock adapted to react to palm pressure by an operator, where the palm interlock is adapted to lock the trigger in the third position when no palm pressure is applied by the operator, and where the palm interlock is adapted to allow the trigger to move from the third position to the first and the second positions when palm pressure is applied to the palm interlock by the operator.

Another aspect of the invention is a harmonic drive coupled between the capstan drum and the motor, where the harmonic drive is adapted to reduce the rotation speed of the capstan drum relative to the rotation speed of the motor, and where the capstan drum can back drive the harmonic drive.

A further embodiment of the invention comprises a base plate, a load bracket coupled to the base plate, the load bracket adapted to support a load, a motor coupled to the base plate, a rotating yoke coupled to the motor, where the motor is adapted to rotate the rotating yoke, a motion activated brake coupled to the rotating yoke, a capstan drum coupled to the motion activated brake, where the motion activated brake has a drive state and a brake state, where the motion activated brake is in the drive state and rotates the capstan drum when the rotating yoke is rotating, where the motion activated brake is in the brake state and prevents the capstan drum from rotating when the rotating yoke is stationary, a pinch roller coupled to the base plate, where the pinch roller is positioned to contact the capstan drum, and where the pinch roller is configured to apply a gripping force against at least one wrap of rope on the capstan drum.

A further aspect of the invention is where the load bracket is adapted to react with the pinch roller, and where the load bracket is configured to reduce the gripping force against the at least one wrap of rope on the capstan drum by the pinch roller when the load supported exceeds a predetermined amount.

A still further aspect of the invention is where the load bracket is adjustable with respect to reaction with the pinch roller.

Further aspects of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The invention will be more fully understood by reference to the following drawings which are for illustrative purposes only:

DETAILED DESCRIPTION OF THE INVENTION

Referring more specifically to the drawings, for illustrative purposes the present invention is embodied in the apparatus generally shown in FIG. 1 through FIG. 15. It will be appreciated that the apparatus may vary as to configuration and as to details of the parts, and that the method may vary as to the specific steps and sequence, without departing from the basic concepts as disclosed herein.

Figure 1:
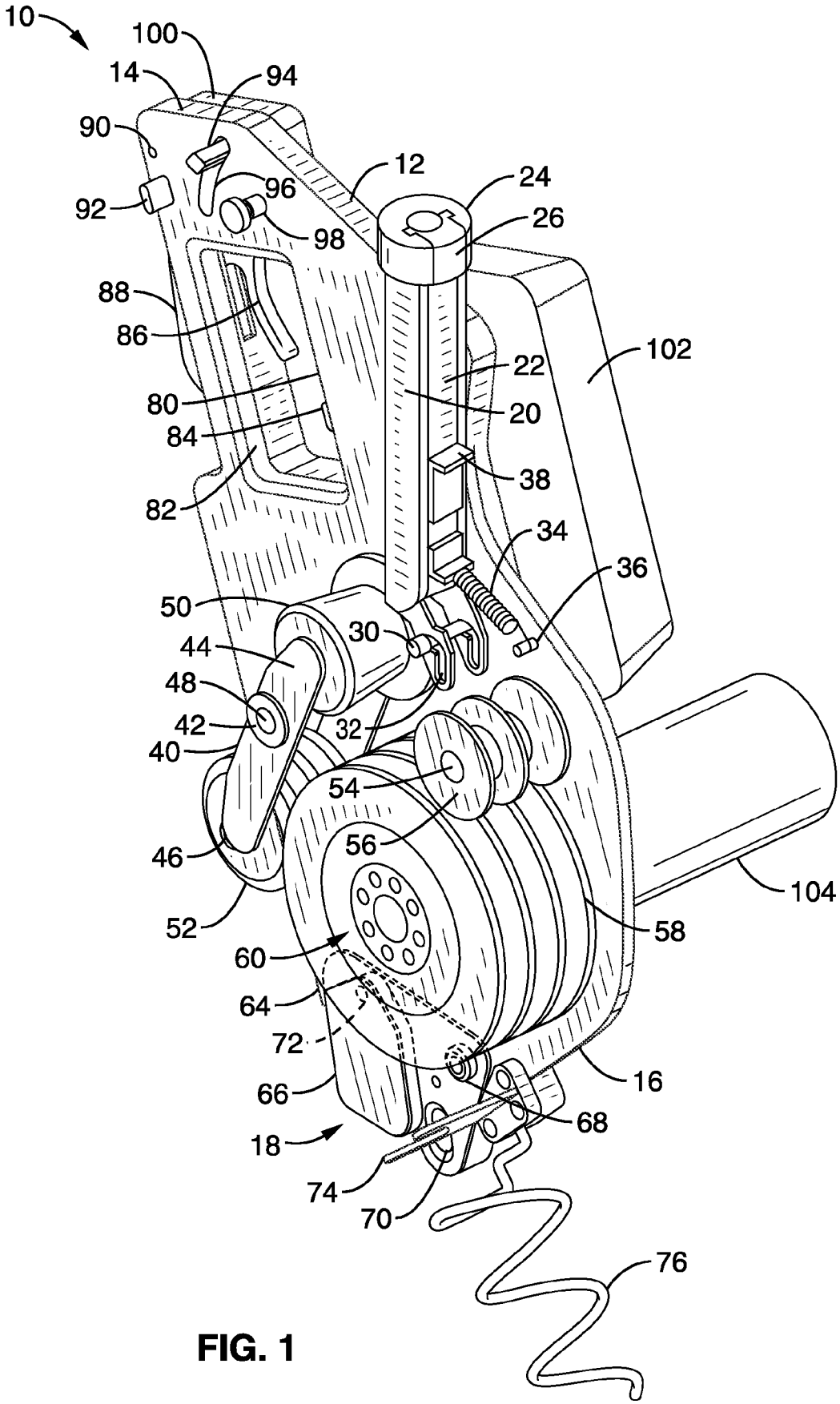
FIG. 1 is a schematic view of the capstan side of a powered rope ascender according to the present invention.

FIG. 1 illustrates a schematic capstan side view of a powered rope ascender generally designated as 10. Safety housings are omitted for clarity. Rope ascender 10 has a base plate 12 with a top end 14 and bottom end 16. Although illustrated here as one component, base plate 12 can be assembled from multiple components without departing from the invention. A load limiting assembly 18 is positioned at the bottom end 16 of base plate 12 and will be described in detail in FIG. 7A and FIG. 7B. An up rope fixed channel 20 is attached to base plate 12 with a moveable channel 22 adapted to mate with fixed channel 20. Fixed channel lock 24 is adapted to receive moveable channel lock 26. Moveable channel 22 is illustrated in an open position in FIG. 2. Shoulder pin 30 secures moveable channel 22 in slot 32. Moveable channel 22 is biased open for threading by spring 34 attached to pin 36. Wing 38 is used as a handle to raise moveable channel 22 so that moveable channel lock 26 clears channel lock 24. Threading a rope through fixed channel lock 24 is described in FIG. 2.

Tension support bracket 40 has center aperture 42, distal spindle 44 and proximal spindle 46 and is supported on base plate 12 at pivot pin 48 with a bushing or rotating sleeve. Distal spindle 44 supports tension roller 50 near the bottom of fixed channel 20 and proximal spindle 46 supports pinch roller 52. A pin 54 is positioned on base plate 12 below fixed channel lock 24 and supports an idler roller 56 rotating on pin 54. Capstan drum 58 is mounted on harmonic drive assembly 60 and is positioned just beneath fixed channel 20 and below idler roller 56. In one embodiment, idler roller 56 is positioned about 30 degrees off vertical from the axis of capstan drum 58. Harmonic drive assembly 60 will be described in the drive train in FIG. 9. Tension roller 50 is positioned so pinch roller 52 will exert a gripping force on a rope wound onto capstan drum 58 when force from a tensioned rope between fixed channel 20 and capstan drum 58 is applied against tension roller 50. In one embodiment of the invention, capstan drum 58 and idler roller 56 have a plurality of grooves to guide and grip a rope. In a preferred embodiment, idler roller 56 has two grooves and capstan drum 58 has three grooves. Evaluation of prototype ascenders have shown that grooves formed with an included angle of about 30 degrees provides an optimum grip on selected rope. In further embodiments (not shown) capstan drum 58 has one groove, two grooves, or more than three grooves. In a still further embodiment (not shown), idler roller 56 is omitted. Capstan drums with textured gripping surfaces instead of grooves are contemplated in further embodiments. In a preferred embodiment, capstan drum 58 is aluminum and about 4 inches in diameter.

Below pinch roller 52, tension arm lever 64 (shown behind capstan drum 58) is coupled to tension arm bracket 40 and extends behind load limit bracket 66. Load limit bracket 66 pivots on dowel 68 in base plate 12. When a load is coupled to aperture 70 of load limit bracket 66 and exceeds a predetermined amount, load limit bracket 66 will pivot on dowel 68 and the resultant force against support dowel 72 will cause tension arm lever 64 to move pinch roller 52 away from capstan drum 58 as will be described in further detail in FIG. 7A and FIG. 7B. Down rope guide bracket 74 and optional down rope spring 76 are mounted at the bottom end 16 of base plate 12.

Rectangular grip opening 80 positioned in base plate 12 near top end 14 forms grip handle 82. Grip handle 82 is configured for gripping by the hand of the operator (not shown). Switch 84 is positioned in grip opening 80 and, in one embodiment, is a key switch to activate powered ascender 10. In other embodiments, switch 84 is a safety switch, or is coupled to a cable remote activation switch or is configured as a radio activated switch. Trigger 86 extends into grip opening 80 and is positioned to be operated by one or more fingers of the operator (not shown). Palm interlock 88 is positioned outside grip handle 82 and is positioned to receive the palm of the operator (not shown). The operation of trigger 86 and palm interlock 88 is described in FIG. 3A through FIG. 3C. Palm interlock 88 pivots on interlock pin 90 in base plate 12. Below interlock pin 90 is brake lock button 92. Reverse button 94 is positioned to slide in groove 96 and is locked in position by detent pin 98. Operation of the aforementioned controls will be described further in FIG. 3A through FIG. 3C.

Linkage housing 100 is attached near top end 14 of base plate 12 and forms part of grip handle 82. Controls enclosure 102 is either formed as part of base plate 12 or attached to the motor side of base plate 12 opposite fixed channel 20. A motor 104 is attached to base plate 12 and mechanically coupled to harmonic drive assembly 60 and capstan drum 58. The drive train for powered rope ascender 10 will be further described in FIG. 9.

Figure 2:
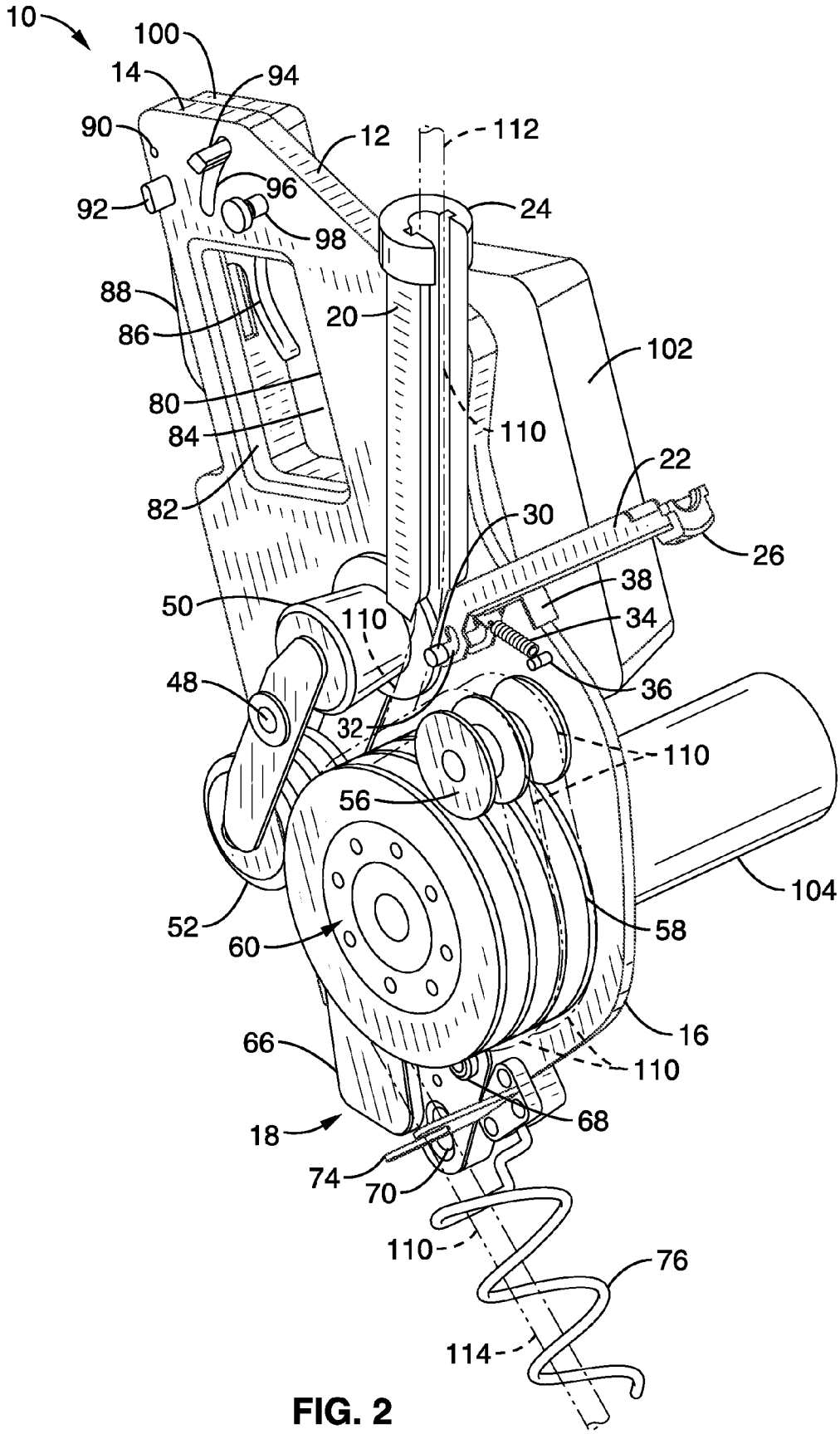
FIG. 2 is a view of the powered rope ascender shown in FIG. 1 with a rope threaded for ascent.

FIG. 2 illustrates powered rope ascender 10 receiving a rope 110, shown in dashed line. Rope 110 has an upper region 112 and a lower region 114 relative to capstan drum 58.

Moveable channel 22 is moved up by wing 38 that releases moveable channel lock 26 from fixed channel lock 24. In another embodiment, moveable channel lock 26 has releasable ball detents (not shown) that engage fixed channel lock 24. Moveable channel 22 pivots open on pin 30 to provide access for rope 110. Upper region 112 of rope 110 is threaded between fixed channel 20 and moveable channel 22 and down past tension roller 50 above capstan drum 58. Rope 110 is shown wrapped twice around capstan drum 58 and idler roller 56 and then down capstan drum 58 past pinch roller 52. In another embodiment (not shown), rope 110 is wrapped once around capstan drum 58 and idler roller 56. In one embodiment, idler roller 56 is canted to guide rope 110 to the adjacent groove in capstan drum 58. Lower region 114 of rope 110 is passed through down rope guide bracket 74 and threaded through rope spring 76. In one aspect of the invention, tension roller 50 is positioned to cause pinch roller 52 to exert a gripping force on rope 110 wound on capstan drum 58 when the tension on the upper region 112 of rope 110 exceeds 10 pounds.

In another embodiment of the invention (not shown), rope 110 is threaded through fixed channel 20, down past tension roller 50, onto capstan drum 58 as an open loop and then directly between pinch roller 52 and capstan drum 58 without looping around capstan drum 58. Then lower region 114 of rope 110 is passed through down rope guide bracket 74.

In a preferred embodiment, rope 110 is a synthetic cordage consisting of a woven or linear core with a knitted outerwear sheath and a 5,200-pound tensile strength. In the embodiment illustrated, powered rope ascender 10 accommodates rope diameters of about 5 mm to about 15 mm with a desired range of about 9 mm to about 13 mm. In an exemplary embodiment, rope 110 is about 13.7 mm in diameter and adapted to maintain a round cross section when threaded on capstan drum 58. Note that rope 110 can be threaded into powered rope ascender 10 without accessing either end of rope 110. It is to be noted that the invention can be practiced with cable, cord, wire, tubing, hose, strap or other filaments without departing from the teaching herein.

Figure 3A:
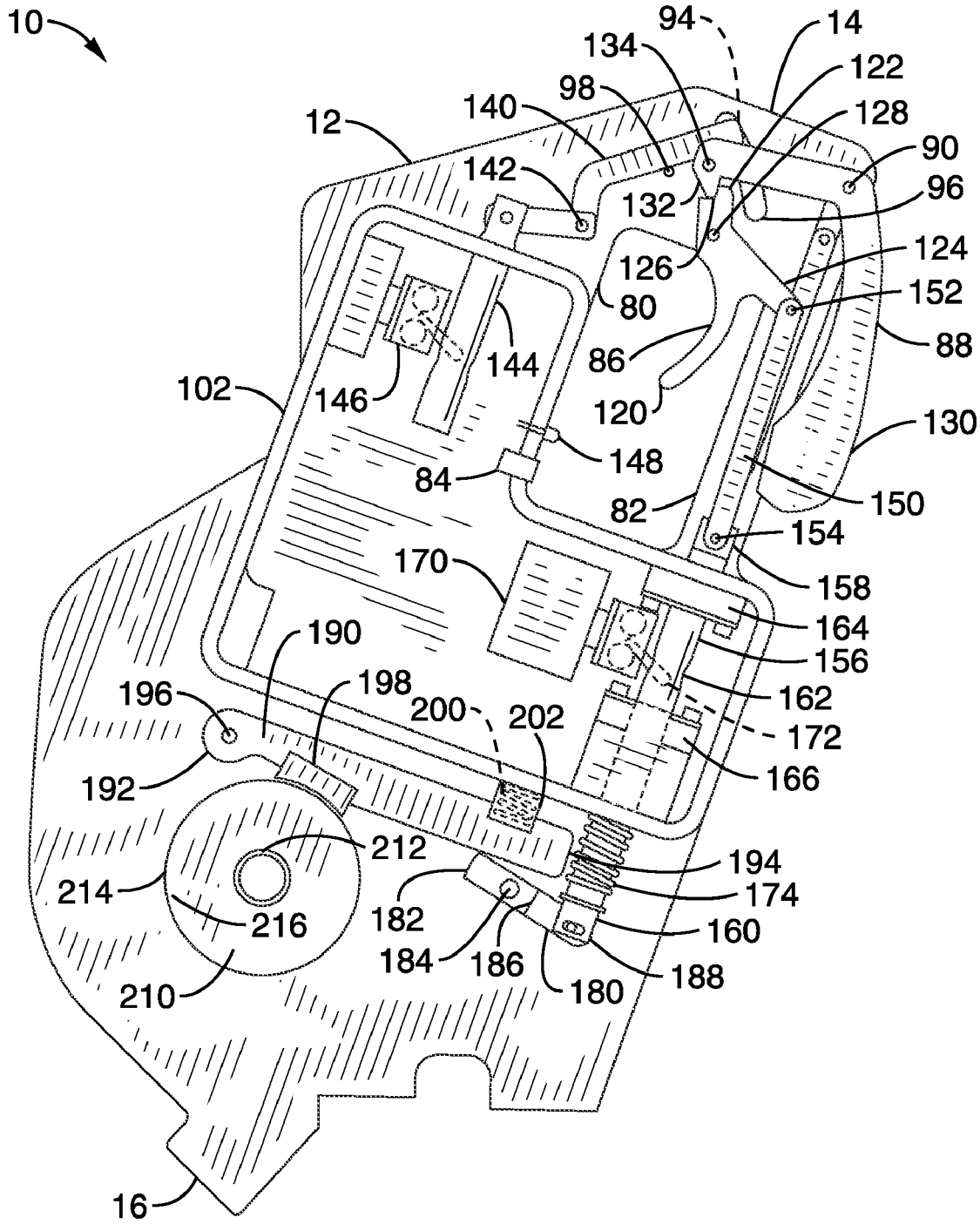
FIG. 3A is a schematic view of the motor side of the powered rope ascender shown in FIG. 1 with the controls in a neutral position.
Figure 3B:
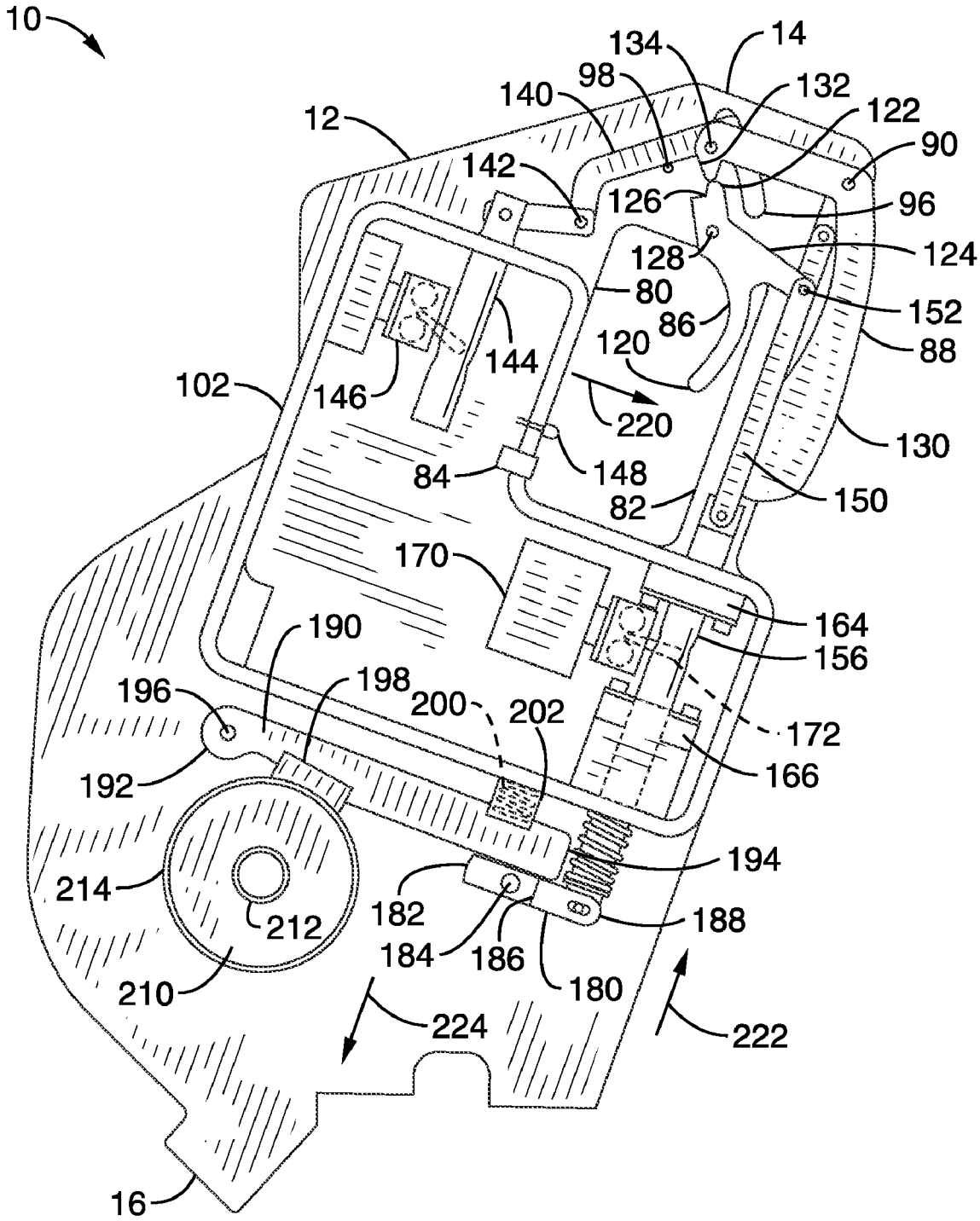
FIG. 3B is a schematic view of the powered rope ascender shown in FIG. 3A in with the controls in a brake position.
Figure 3C:
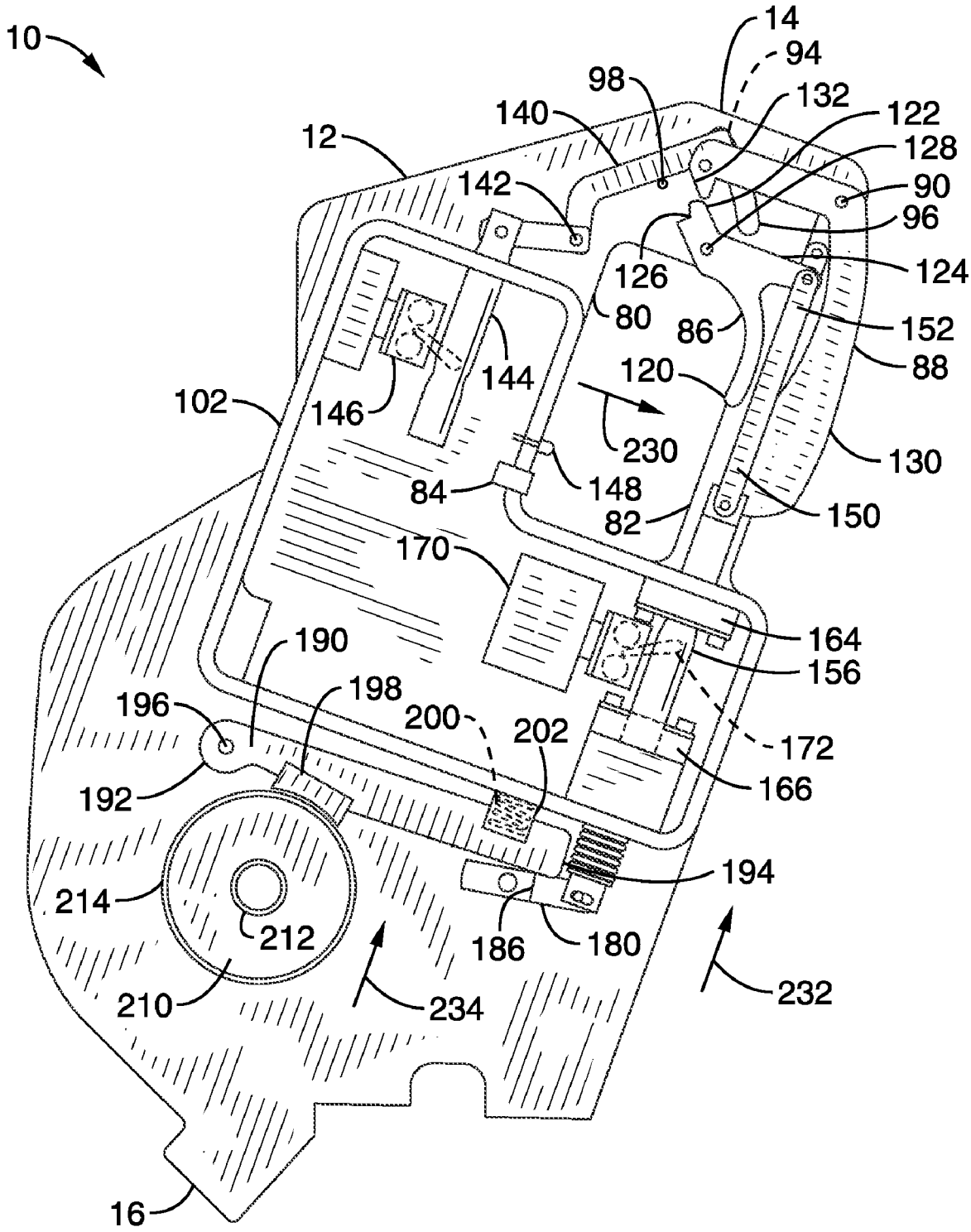
FIG. 3C is a schematic view of the powered rope ascender shown in FIG. 3A in with the controls in an ascending position.

FIG. 3A through FIG. 3C are motor side views of control positions for powered rope ascender 10. Controls are illustrated schematically and linkage housing 100 and a cover on controls enclosure 102 are omitted for clarity. FIG. 3A shows trigger 86 in a neutral position. FIG. 3B shows trigger 86 in a brake position and FIG. 3C shows trigger 86 in a position to energize the motor 104.

In FIG. 3A, controls enclosure 102 has walls that project out from base plate 12 formed in a generally "L" shape with the inside of the "L" adjacent to grip aperture 80. Trigger 86 has trigger handle 120, trigger head 122 and trigger heel 124 as shown. Trigger head 122 has interlock notch 126 towards the front of trigger head 122 and pivot aperture 128 between trigger head 122 and trigger handle 120. Trigger 86 pivots around pivot aperture 128 on a pivot pin mounted in base plate 12.

Palm interlock 88 has a general "L" shape with a handle 130 at the long end of the "L" and a pawl 132 positioned inside the short end of the "L". Pawl 132 is configured to mate with interlock notch 126 on trigger head 122. For safety, palm handle 88 must be pressed inward to disengage pawl 132 from interlock notch 126 before trigger 86 can be moved from the neutral position. Pawl 132 has a pin 134 that supports a tension spring (not shown for clarity) connected to the pin at pivot aperture 128 to keep pawl 132 biased against interlock notch 126.

Reverse button 94 (shown in FIG. 1) is connected to reverse link 140 and is configured to rotate on pin 142. Detent pin 98 through base plate 12 is positioned to secure reverse link 140 in either an up position or down position. A compression spring (not shown for clarity) is used to bias detent pin 98 down and secure reverse link 140. Reverse control rod 144 is connected to reverse link 140 and reacts with two-position or two setting reverse switch 146 positioned in the upper region of control enclosure 102. In one embodiment, reverse switch 146 reverses the polarity to a DC motor 104 (shown in FIG. 1). In another embodiment (not shown), reverse switch 146 activates a solenoid or other device to reverse direction through a gear drive or air valve coupled to motor 104. In further contemplated embodiments, reverse switch 146 has more than two positions for multiple speeds or other modes of operation. An LED indicator 148 is shown mounted above key switch 84 and is representative of visual indicators of operational status of powered ascender 10. In an exemplary embodiment, visual indicators include an elapsed running time indicator, a capstan drum rotation (distance) indicator, and a power availability (such as battery power or air pressure) indicator.

Returning to trigger 86, a throttle tension link 150 has a proximal end 152 and a distal end 154. Proximal end 152 couples to trigger heel 124. Brake link 156 has a proximal end 158 coupled to distal end 154 of throttle tension link 150, a distal end 160 and a toggle aperture 162 about midway between proximal, distal ends 158, 160. Brake link 156 is supported in upper brake arm bushing 164 and lower brake arm bushing 166 mounted to base plate 12 and within control enclosure 102. Three position switch 170 is mounted in control enclosure 102 and has toggle 172 configured to react with toggle aperture 162. A compression spring 174 is positioned between the bottom wall of control enclosure 102 and distal end 160 of brake link 156 to bias brake link 156 downward.

Below control enclosure 102 and coupled to distal end 160 of brake link 156 is brake cam 180. Brake cam 180 has distal end 182, pivot point 184, contact point 186 and proximal end 188. Brake cam 180 rotates on a pin in base plate 12 at pivot point 184. Brake cam 180 has a wide section from distal end 182 to contact point 186. In this view, brake cam 180 is biased clockwise by compression spring 174.

Positioned between control enclosure 102 and brake cam 180 is brake arm 190. Brake arm 190 has proximal end 192 to the left and distal end 194 positioned to the right and over brake cam 180. Brake arm 190 is mounted to base plate 12 below controls enclosure 102 on pin 196 at proximal end 192. A brake pad 198 is attached to the lower side of brake arm 190 near proximal end 192. Distal end 194 is positioned between controls enclosure 102 and brake cam 180 to react with the wide section of brake cam 180 as will be described shortly. Compression brake spring 200 shown in hidden line is positioned near distal end 194 of brake arm 190 and is configured to react with the control enclosure 102 and bias brake arm 190 against the upper surface of the wide section of brake cam 180 between distal end 182 and contact point 186. A spring enclosure 202 is positioned on brake arm 190 to keep brake spring 200 in place.

A brake drum 210 is mounted on the axis of harmonic drive assembly 60 (shown in FIG. 1) and has center aperture 212, outside surface 214 and inside surface 216. Brake drum 210 also functions as part of a clutch described in FIG. 7 and is interchangeably referred to as a clutch drum 210. Brake pad 198 is positioned to contact outside surface 214 of brake drum 210 when brake arm 190 is aligned with brake cam 180.

In FIG. 3A, the controls are in a neutral mode. Palm interlock 88 is out so that pawl 132 engages interlock notch 126 holding trigger 86 in the first position. Toggle 172 of switch 170 is in a down position in aperture 162. In this position, the motor is disengaged. Brake cam 180 is rotated in a clockwise position and distal end 182 of brake cam 180 is forcing brake arm 190 upward releasing contact between brake pad 198 and outside surface 214 of brake drum 210. In this position, powered ascender 10 is in freewheel mode allowing brake drum 210 and capstan 58 (shown in FIG. 1) to turn freely.

FIG. 3B illustrates the controls in a brake mode. Palm interlock 88 has been pressed in such as by pressure from the palm of the operator's hand. Pawl 132 is raised to clear interlock notch 126 on trigger top 122. Trigger handle 120 has been moved to the right shown by arrow 220. Throttle tension link 150 and brake link 156 are moved upward as designated by arrow 222. Toggle 172 of switch 170 is moved to a middle position by the upward motion of brake link 156. In this middle position, the motor 104 (shown in FIG. 1) is disengaged. Brake cam 180 is rotated counter clockwise by movement of brake link 156 and is positioned parallel to brake arm 190. Brake arm 190 rotates clockwise on pin 196 by the bias of brake spring 200 as shown by arrow 224 and brake pad 198 contacts outside surface 214 of brake drum 210 (also used as a clutch drum in FIG. 9). In this position, brake drum 210 is restrained from rotating by friction.

FIG. 3C illustrates the controls in an ascending mode. Reverse button 94 is shown in the up position in groove 96. This places the toggle of reverse switch 146 in a down position. Palm interlock 88 has been pressed in such as by pressure from the palm of the operator's hand. Pawl 132 is raised to clear interlock notch 126 on trigger top 122. Trigger handle 120 has been moved to the far right shown by arrow 230. Throttle tension link 150 and brake link 156 are moved upward as designated by arrow 232. Toggle 172 of switch 170 is moved to an upper position by the upward motion of brake link 156. This up position engages motor 104 to drive capstan drum 58 (shown in FIG. 1). Brake cam 180 is rotated counter clockwise by upward movement of brake link 156 and is positioned so that contact point 186 exerts an upward force on distal end 194 of brake arm 190 as shown by arrow 234. Brake pad 198 is raised away from outside surface 214 of brake drum 210 to release the brake. In another embodiment of the invention (not shown), movement of toggle 172 between the middle position in FIG. 3B and the upper position in FIG. 3C provides speed control to motor 104.

In a descending mode (not shown), reverse button 94 is positioned in the lower part of groove 96 and the toggle of switch 146 is in an up position. Motor 104 would be energized to operate in reverse. In one aspect of this mode, motor 104 would be configured to rotate at a lower speed in reverse such as about 2 to about 3 ft/sec down the rope.

Figure 4:
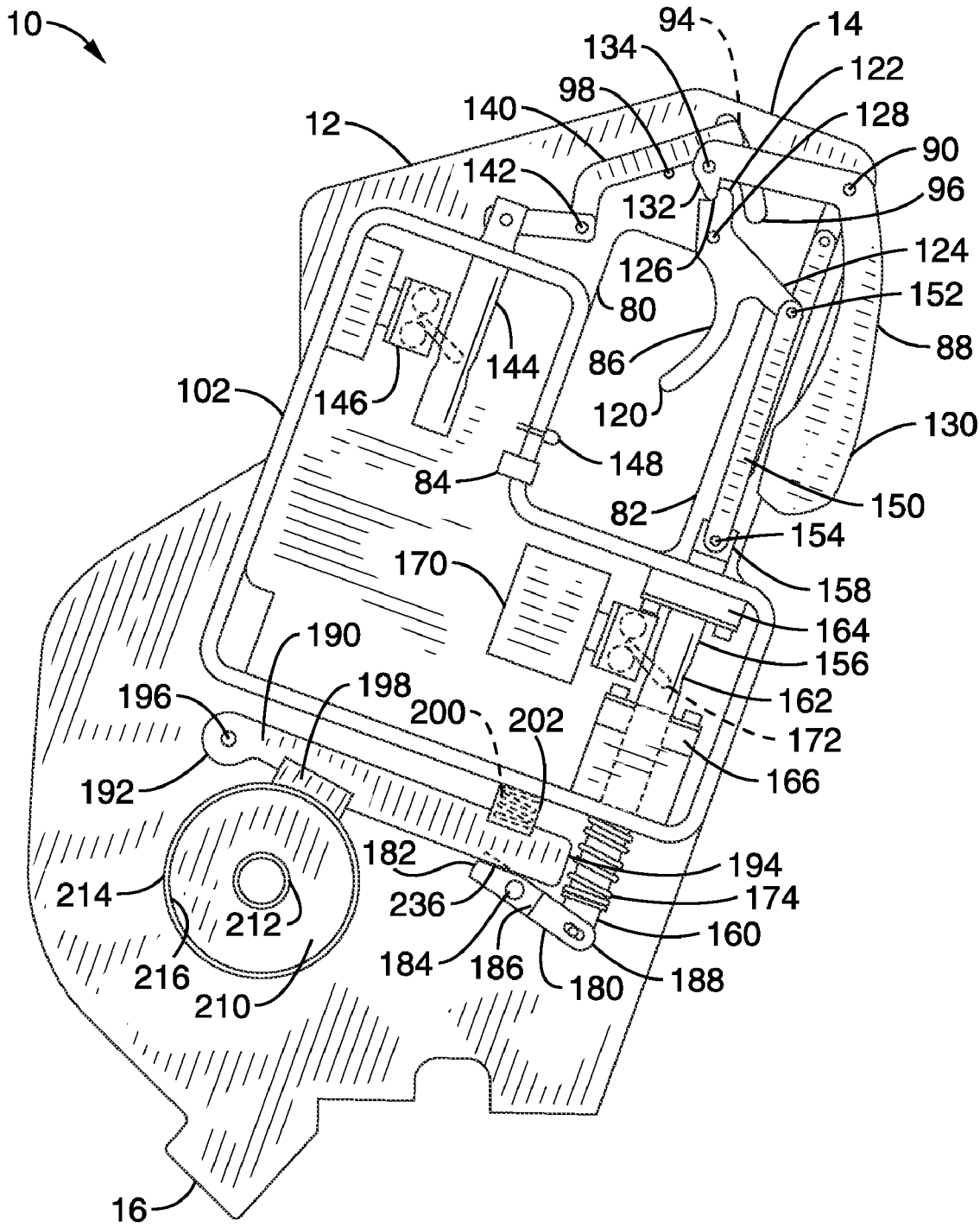
FIG. 4 is a schematic view of another embodiment of the powered rope ascender shown in FIG. 3A shown with another configuration of brake controls.

FIG. 4 illustrates a motor side view of another embodiment of the powered ascender 10 shown in FIG. 3A through FIG. 3C. Distal end 182 of brake cam 180 has part of the wide section removed at position 236 so that when the controls are in the neutral position (as described previously in FIG. 3A), brake arm 190 is rotated downward but brake pad 198 is biased against outside surface 214 of brake drum 210 by brake spring 200. In this embodiment, brake drum 210 and capstan 58 are restrained from rotating by friction when the controls are in the neutral mode (shown here) or in the middle position (shown in FIG. 3B). In order to release brake drum 210 to freewheel, motor 104 must be de-energized (such as switching off key switch 84) and the controls placed in the ascending mode (shown in FIG. 3C) or descending mode (described in the previous paragraph). In practice, this embodiment of the invention has two control positions, a brake mode, with or without the palm interlock released, and an ascending/descending mode with the palm interlock released and trigger fully moved to the right.

Figure 5:
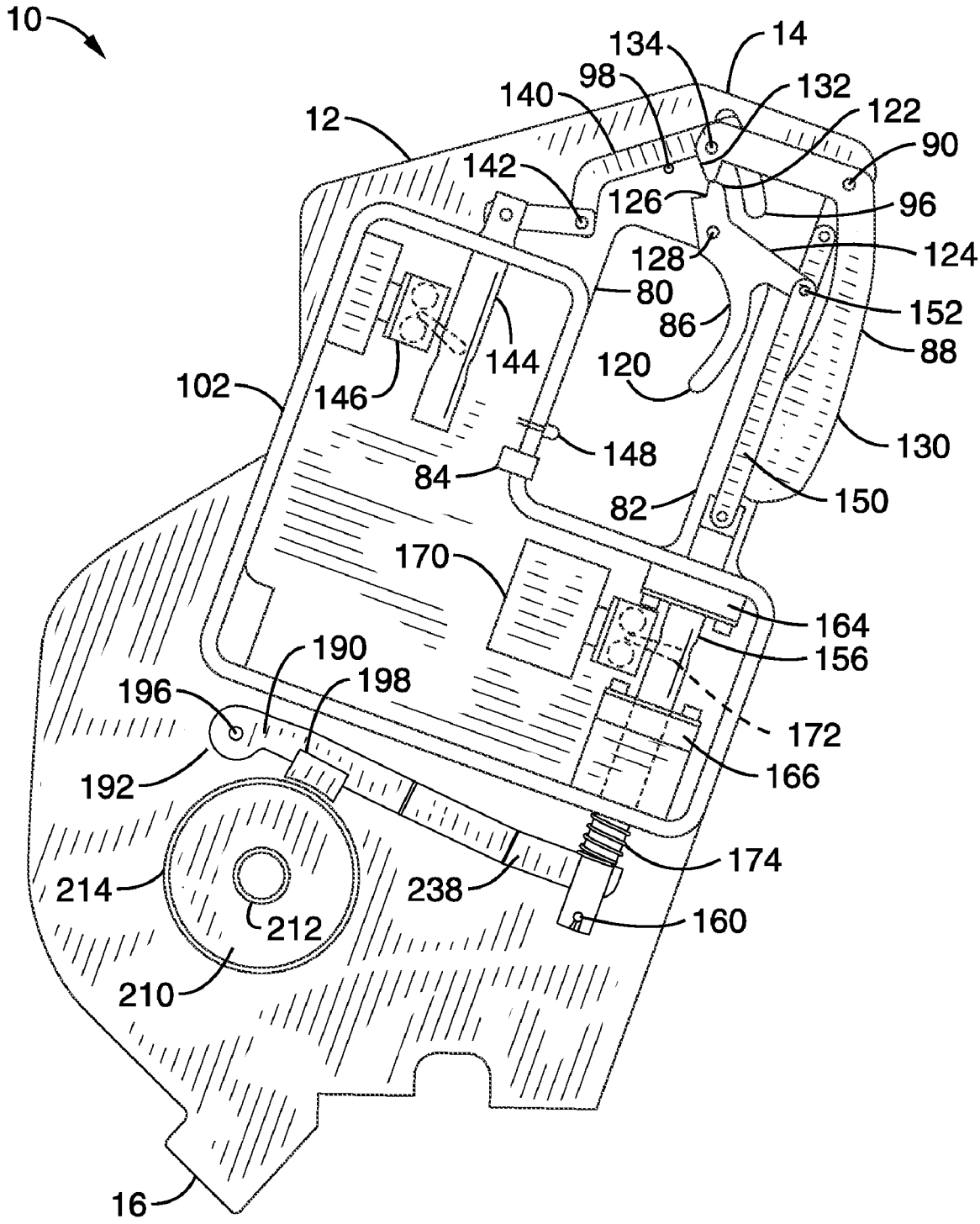
FIG. 5 is a schematic view of a further embodiment of the powered rope ascender shown in FIG. 3A shown with the brake arm coupled directly to the brake linkage.

FIG. 5 illustrates a motor side view of a further embodiment of the powered ascender 10 shown in FIG. 3A through FIG. 3C. Here, brake arm 190 is modified at distal end 238 to connect directly near distal end 160 of brake link 156 below compression spring 174. In this configuration, when controls are in the neutral position, (as described previously in FIG. 3A), brake arm 190 is rotated downward and brake pad 198 is biased against outside surface 214 of brake drum 210 by compression spring 174.

When controls are in the middle position, as shown here, brake arm 190 is rotated upward releasing contact between brake pad 198 and outside surface 214 of brake drum 210. In this position, powered ascender 10 is in freewheel mode allowing brake drum 210 and capstan 58 (shown in FIG. 1) to turn and backdrive through harmonic drive assembly 60. The backdrive resistance through the drive system provides a relatively slow, non-powered descent. Manipulating trigger 86 between the neutral and middle position provides a variable braking action during a non-powered descent. Releasing trigger 86 to the neutral position will cause compression spring 174 to apply brake pad 198 and stop the non-powered descent.

When controls are in ascending mode (see FIG. 3C) brake arm 190 is rotated further upward keeping brake pad 198 released from brake drum 210 when motor 104 is energized by switch 170.

Figure 6:
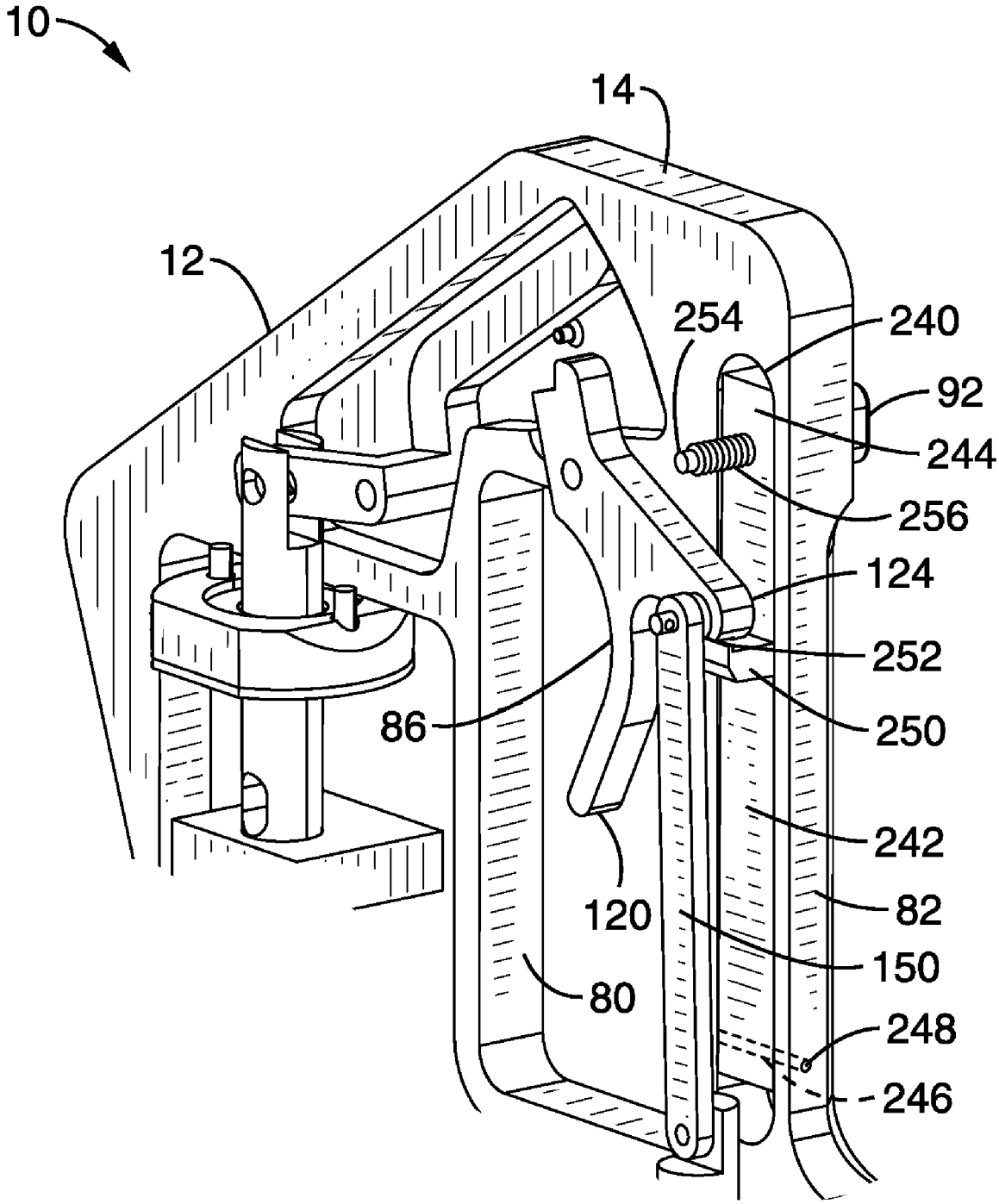
FIG. 6 is a detailed view of a brake lock for the powered rope ascender shown in FIG. 3A.

FIG. 6 illustrates a detail perspective view of a brake lock for powered rope ascender 10 shown in FIG. 3A through FIG. 3C. Linkage cover 100 and palm interlock 88 have been removed for clarity. Trigger lock groove 240 is positioned vertically in grip handle 82 and accommodates trigger lock arm 242. Trigger lock arm 242 has distal end 244, and proximal end 246. Lock button 92 on capstan side of base plate 12 is coupled to distal end 244 through an aperture (not shown) in grip handle 82. A pin 248 secures proximal end 246 of trigger lock arm 242 in groove 240 but allows rotation of trigger lock arm 242 approximately perpendicular to base plate 12. Locking pawl 250 has lip 252 and is positioned on trigger lock arm 242 to engage trigger heel 124 when trigger 86 is in the brake position shown in FIG. 3B. Spring pin 254 is positioned at the distal end 244 of trigger lock arm 242 and supports compression spring 256 that loads against linkage cover 100 (shown in FIG. 1). By moving trigger 86 to the brake position (shown in FIG. 3B) and simultaneously pushing brake lock button 92, locking pawl 250 will engage trigger heel 124 and trigger 86 will remain in the brake position without the operator holding trigger 86. Moving trigger handle 120 back slightly allows trigger heel 124 to clear lip 252 of locking pawl 250 and spring 256 will move the distal end 244 of trigger lock arm 242 back into groove 240 where trigger heel 124 can move past pawl 250.

Figure 7A:
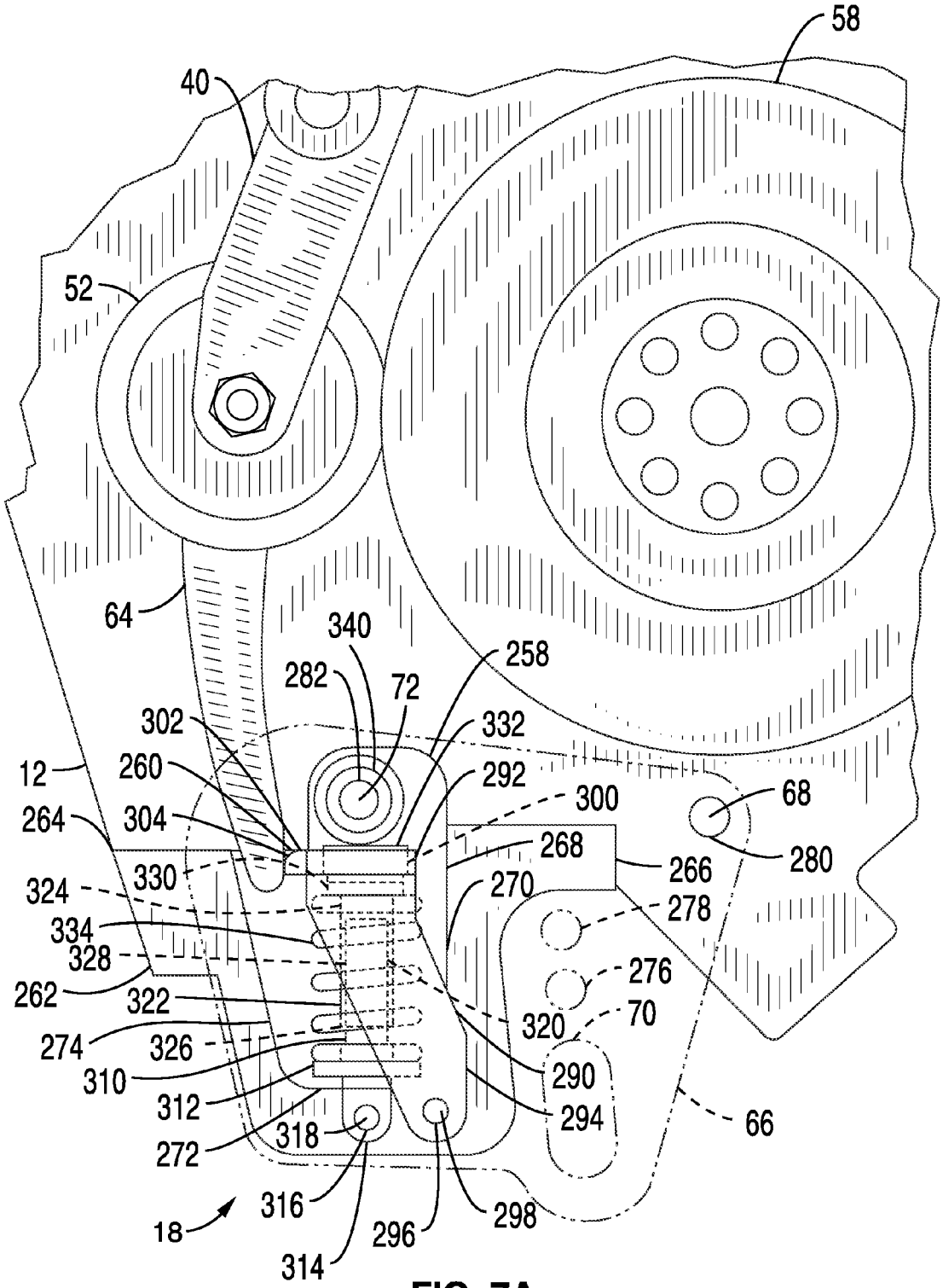
FIG. 7A is a detail view of the load limiting assembly on the powered rope ascender shown in FIG. 1.
Figure 7B:
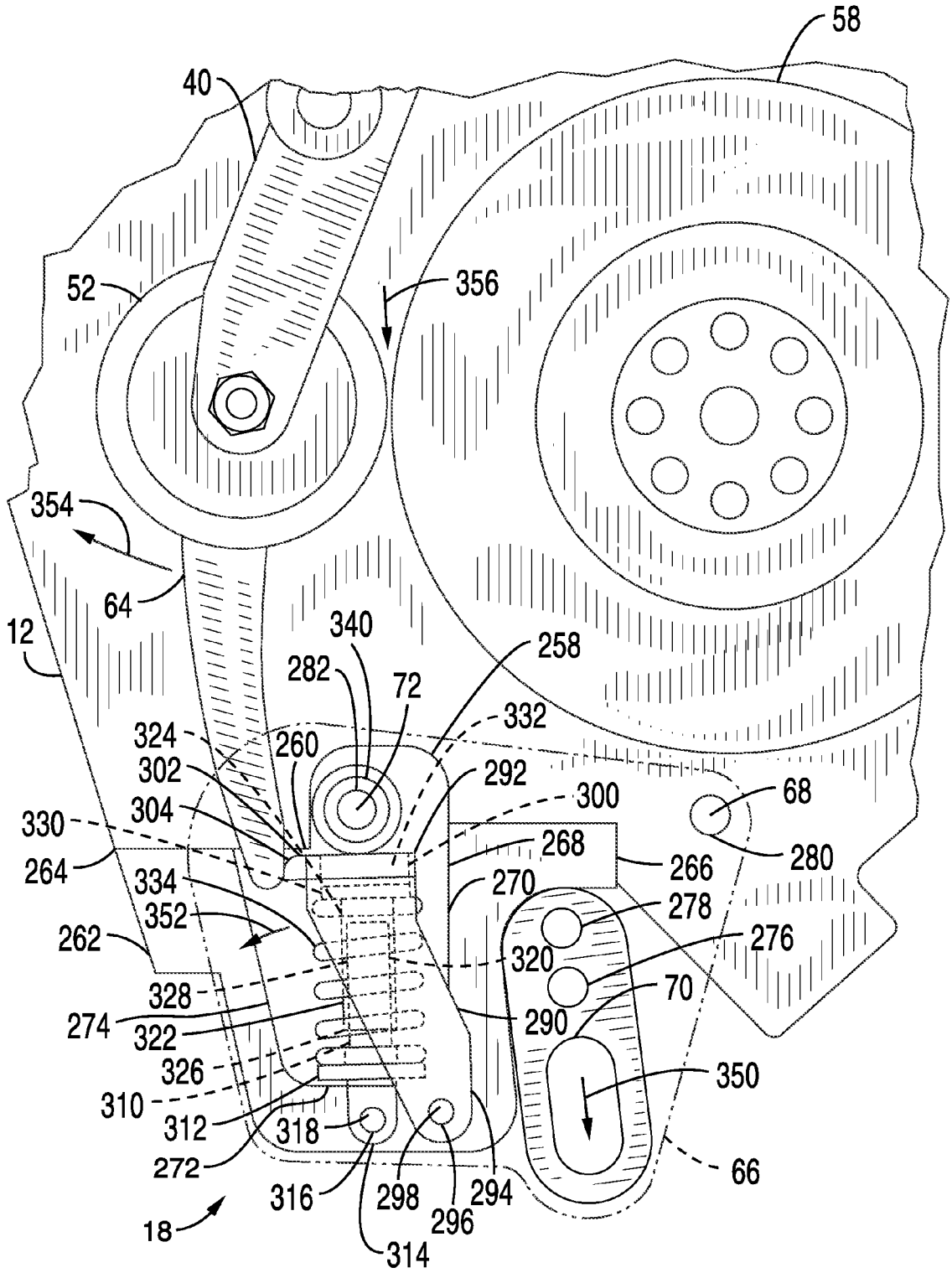
FIG. 7B is a detail view of the load limiting assembly shown in FIG. 7A where the load exceeds a predetermined amount.

FIG. 7A and FIG. 7B illustrate plan views of load limiting assembly 18 in a loaded and an overloaded condition for powered rope ascender 10. Down rope guide bracket 74 and down rope spring 76 are omitted for clarity. Load bracket 66 is shown in transparent line for clarity. A rectangular cut out 258 with radiused corners is positioned near the bottom and in base plate 12. Base plate 12 has a horizontal surface 260 adjacent to the left of cut out 258. A load limit support bracket 262 has left flange 264, right flange 266 and cut out 268 and is coupled to base plate 12 at left flange 264 and right flange 266. Left flange 264 is coupled at horizontal surface 260. Cut out 268 has a vertical right edge 270, a horizontal bottom edge 272 and a left edge 274 that slopes outward. In a preferred embodiment, vertical right edge 270 aligns with cut out 258 in base plate 12.

Load bracket 66 is illustrated as one component for clarity but in a preferred embodiment, comprises two mating components, coupled together at apertures 276 and 278, and positioned on both sides of base plate 12. Load bracket 66 has pivot aperture 280, and roller support aperture 282. Pivot aperture 280 is supported by dowel 68 through base plate 12. Roller support aperture 282 is supported by a spring loaded support assembly described below.

Pivot support bracket 290 has a roller support platform 292 and bifurcated legs 294 that extend down on each side of load limit support bracket 262 past bottom edge 272. Each leg 294 has an aperture 296 at the bottom that is supported by pin 298 through the bottom of load limit support bracket 262. Roller support platform 292 has a slot opening 300 oriented parallel to base plate 12, a top surface position 302 that reacts with horizontal surface 260 of base plate 12, and a radiused nose 304 that is configured to react with tension arm 64.

A spring support clevis 310 has a base flange 312 with a clevis fork 314 below with aligned apertures 316 that receive a pin 318 through the bottom of load limit support bracket 262 below bottom edge 272. Above base flange 312 is support rod 320 shown in phantom. A cylindrical spring retainer 322 has distal end 324 and proximal end 326 with a bore 328 at proximal end 326 configured to fit over support rod 320. Distal end 324 is configured with a top flange 330 having an elongated platen 332 that fits in slot opening 300 and extends above roller support platform 292. A compression spring 334 is positioned between base flange 312 of support clevis 310 and top flange 330 of spring retainer 322. A roller 340 is positioned on platen 332 in cutout 258 of base plate 12 and is coupled to load bracket 66 through dowel 72. In one embodiment (not shown), roller 340 is a needle bearing. In another embodiment (not shown), roller 340 is a slider block and rail or other low-friction element.

In the configuration shown in FIG. 7A, compression spring 334 biases top flange 330 against roller support platform 292. Top surface position 302 of roller support platform 292 reacts against horizontal surface 260 of base plate 12.

In FIG. 7B an excessive load is placed on load bracket 66 through load aperture 70 as designated by arrow 350. Dowel 72 exerts a downward force on roller 340 proportional to the load in aperture 70. Roller 340 exerts a downward force on platen 332 causing a compression of spring 334. When the load 350 equals a predetermined amount, platen 332 is forced into slot 300 and roller 340 reacts with the top of roller support platform 292. When the load 350 exceeds a predetermined amount, further downward movement of roller 340 causes a rotation of pivot support bracket 290 counterclockwise designated by arrow 352. Radiused nose 304 of load support platform 292 reacts with tension arm 64 moving it outward designated by arrow 354 and releasing the gripping force of pinch roller 52 on a rope positioned over capstan drum 58 at the location designated by arrow 356. The load required to move load support platform 292 against tension arm 64 can be determined by the positioning of pivot apertures 280 and 282, different sizes of spring 334 or different depths of platen 332.

In a further embodiment (not shown) an adjustable contact tip is attached to the end of tension arm 64 to adjust contact travel with radiused nose 304. This adjustable contact tip can be used to compensate for different diameter ropes or to calibrate for the predetermined load amount.

In one mode, load limit assembly 18 will release gripping force momentarily before reengaging pinch roller 52 to reduce shock loading on capstan drum 58 and the drive train such as when dynamic loads are generated by suddenly removing slack in the supporting rope or starting or stopping ascent or descent. In this mode, potential shock loads of 2 times up to 10 times the rated capacity can be maintained below the structural capacity by load limit assembly 18. In another mode, load limit assembly 18 will prevent a sufficient gripping force for ascending with a static load that exceeds a predetermined amount. In one embodiment, load limiting assembly 18 is configured to fully disengage pinch roller 52 and prevent sufficient gripping force for ascending when the load exceeds 350-450 pounds. In a still further embodiment, load limiting assembly 18 is configured to prevent sufficient gripping force for ascending when supporting a static load exceeding 500 to 1000 pounds.

Figure 8:
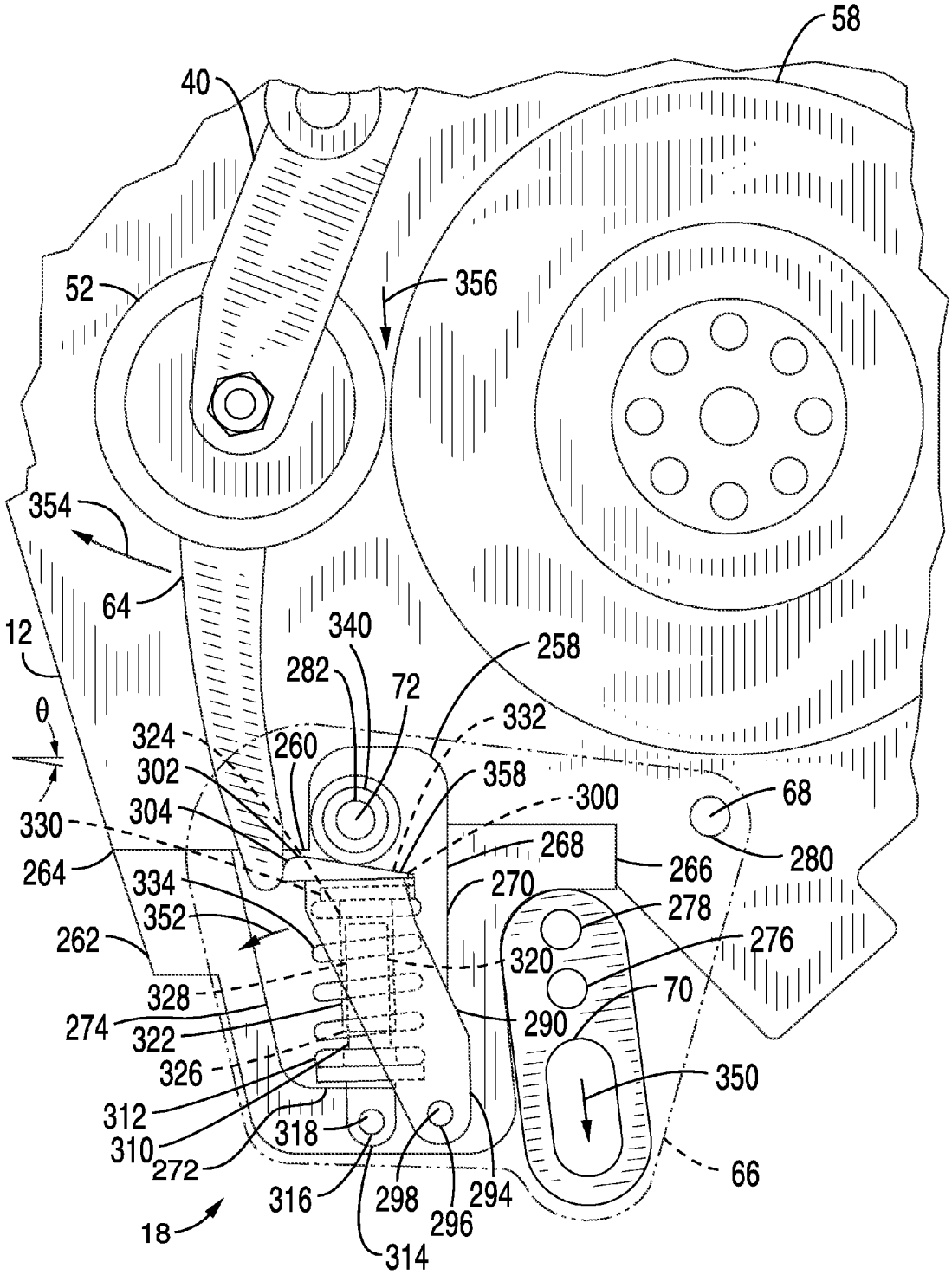
FIG. 8 is a detail view of another embodiment of the load limiting assembly shown in FIG. 7B with an angled load support platform.

FIG. 8 illustrates another embodiment of the invention where an angled support platform, designated 358, is oriented at a downward angle θ relative to horizontal surface 260. Outward force exerted through radiused nose 304 from downward force through dowel 72 and roller 340 is increased based on a function of the sine of angle θ. In one embodiment, angle θ is about 30 degrees. In a further embodiment (not shown), platen 332 has a surface angle of θ.

It is contemplated that in normal use, a belay rope or cable (not shown) will be attached to the operator through a harness and that existing anti-fall devices will be used with the belay rope to ensure safe operation. Although contemplated to support loads while ascending a vertical rope, the invention can be used to maneuver a load on a non-vertical tensioned rope supported between two points including a horizontal rope. The load can be suspended or dragged along a non-vertical surface.

In an contemplated application of the invention (not shown), a powered rope ascender is suspended from a rope (or cable) attached to a portable rescue structure, such as a crane, boom or gantry. The rescue structure with the rope ascender can be moved to the location of personnel requiring extraction such as a pilot in a disabled aircraft. The personnel can access the suspended rope ascender for self extraction or be assisted by rescue personnel suspended by another rope ascender. The rope ascender can also be configured to be operated remotely by rescue personnel.

Figure 9:
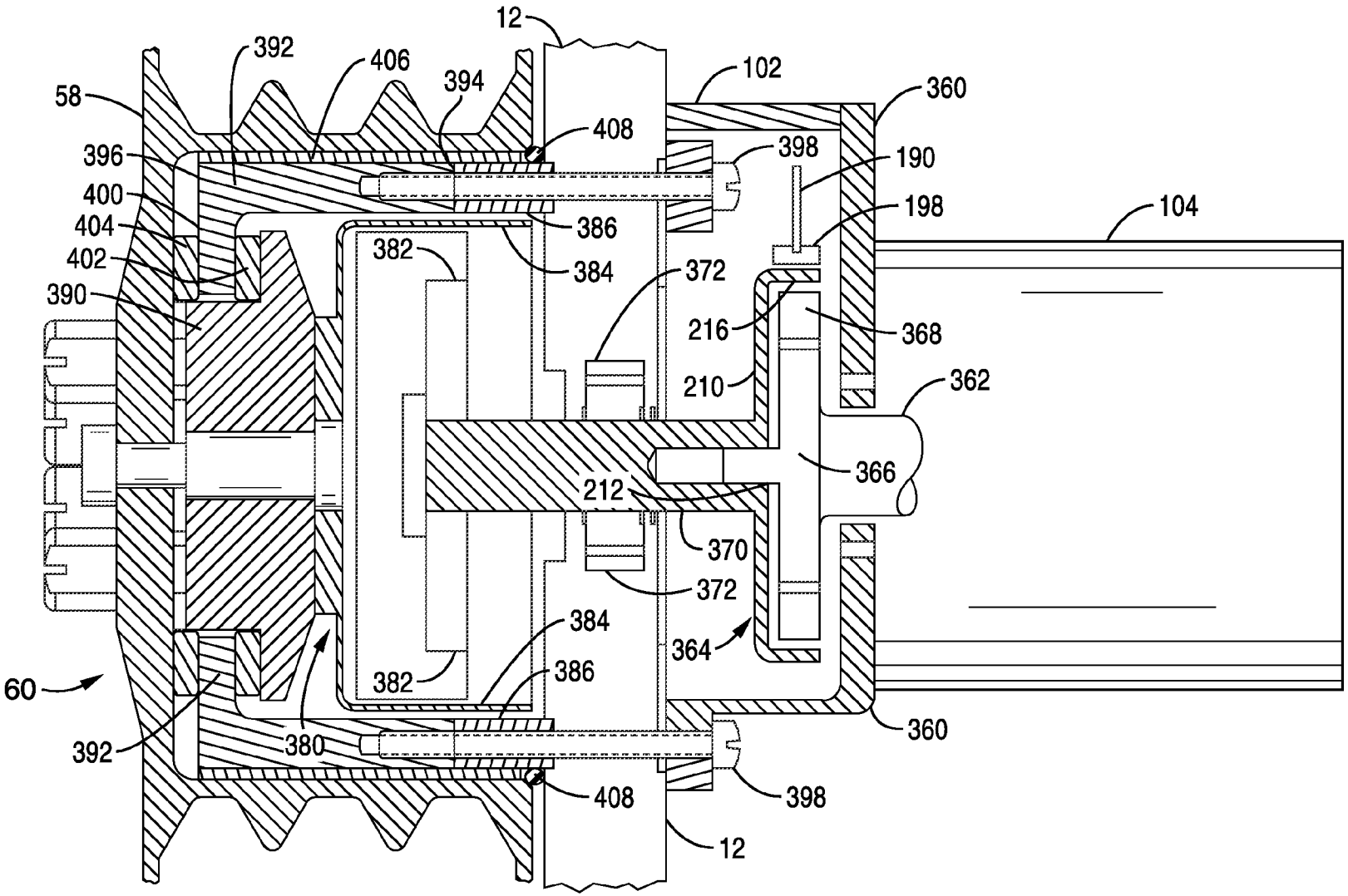
FIG. 9 is a cross section view of a drive train assembly of the powered rope ascender shown in FIG. 1 with a harmonic drive.

FIG. 9 illustrates a cut away cross section view of a drive train for a powered rope ascender. Some components such as base plate 12 and motor 104 are not illustrated in cut section for clarity. Motor 104 is coupled to base plate 12 by a motor housing 360. Motor input shaft 362 is coupled to centrifugal clutch assembly 364 at shoe drive plate 366. Shoe drive plate 366 supports clutch shoes 368 that engage inside surface 216 of centrifugal clutch drum 210 (shown in FIG. 2A as brake drum 210) when motor 104 reaches engagement speed. In one embodiment, centrifugal clutch assembly 364 generates less than 1 inch-pound of torque at less than 1000 rpm and up to 10 inch-pounds of torque at about 3000 rpm.

In another embodiment (not shown) shoe drive plate 366 is omitted, motor input shaft 362 is coupled directly to centrifugal clutch drum 210 at aperture 212 and motor 104 is configured with sufficient starting torque or an integrated centrifugal clutch.

The output shaft 370 of centrifugal clutch assembly 364 is supported in base plate 12 by bearing 372. Harmonic drive assembly 60 has a harmonic drive system 380 coupled to output shaft 370. Harmonic drive system 380 consists of an asymmetrical wave generator 382, flex spline 384 and circular spline 386. Wave generator 382 is coupled to output shaft 370 and circular spline 386 is coupled to base plate 12. In a preferred embodiment, circular spline 386 is inset into base plate 12. In operation, teeth (not shown for clarity) on the outer surface of flex spine 384 interact with teeth (not shown for clarity) on the inner surface of circular spline 386 as asymmetrical wave generator 382 rotates. Based on teeth configuration, flex spline 384 rotates in the opposite direction of wave generator 382 at reduction ratios typically on the order of 50:1 to about 500:1 or more. In a preferred embodiment, a reduction ratio of about 100:1 is used. Rotation output from flex spline 384 is coupled to spool 390 which is coupled directly to capstan drum 58. In one embodiment (not shown), harmonic drive system 380 is contained in a closed oil bath.

Coupled to circular spline 386 is cylindrical capstan axle 392 having proximal end 394 and distal end 396. Support screws 398 extend through base plate 12 and circular spine 386 and into the proximal end 394 of capstan axle 392 to support harmonic drive assembly 60 and transfer the force moment and torque from capstan 58 to base plate 12. In one embodiment, twelve each number 8 socket screws 398 are mounted in about a 3 inch diameter circle on base plate 12. Distal end 396 of capstan axle 392 forms an annular cap 400 that encloses spool 390. Thrust bushing 402 is positioned between spool 390 and annular cap 400. Thrust bushing 404 is positioned between annular cap 400 and the top of capstan drum 58. Thrust bushings 402 and 404 function to react to the force moment of capstan drum 58 against base plate 12 when supporting a load. In other embodiments (not shown), thrust bushings 402, 404 are combination radial and thrust bearings.

A cylindrical bushing 406 is press fitted on capstan drum 58 and supports the radial loads of capstan drum 58 on capstan axle 392. An O-ring 408 is shown positioned between base plate 12 and capstan drum 58 to seal in lubrication and prevent entry of contamination.

In other embodiments (not shown), Capstan drum 58 is supported on bearings or bushings where O-ring 408 is positioned and/or spool 390 is supported on bearings or bushings mounted in the opening of annular cap 400.

In one mode of the invention, harmonic drive system 380 has a 50:1 reduction ratio. In further modes, harmonic drive system 380 has about a 20:1 to about a 100:1 reduction ratio. In other embodiments of the invention planetary gearing or other speed reduction methods are used in place of or with harmonic drive system 380.

It should be noted that in certain preferred embodiments, capstan 58 can backdrive harmonic drive system 380 when brake pad 198 is released from brake drum 210 and clutch shoes 368 are disengaged, such as when the motor is not rotating. This allows an operator to rotate capstan drum 58 during threading by releasing the brake pad 198 or descend with the motor 104 de-energized using only brake pad 198 against brake drum 210 and friction in harmonic drive system 380 to control descent speed as previously described in FIG. 5. In a further embodiment (not shown) clutch shoes 368 are controlled electromagnetically to engage motor 104 during backdrive to add resistance to a controlled descent or engage a regenerative braking system in motor 104 (not shown). It is to be appreciated that a separate regenerative braking system (not shown) can be added to the drive train shown in FIG. 9 without departing from the teachings of the invention.

In an exemplary embodiment of the invention (not shown), a brushless DC motor is used for motor 104. Brushless DC motors use electronic commutation of the coils on the stator and are capable of high speeds and torque without arcing. In a further arrangement, a sensorless, brushless DC motor is used. A sensorless motor must be started with little or no load. The presence of centrifugal clutch assembly 364 allows this motor to start or reverse direction with no load. In a still further arrangement, a 2-pole, sensorless, brushless DC motor is used. In a further embodiment, a direct drive, brushless DC motor with no gear reduction is used. In another mode of this embodiment, a brushless DC motor with an integral 6.7:1 planetary gear set developing 12 inch-pounds of torque at 6,000 rpm when powered with a 30 cell battery pack operating at 36 VDC is used. When coupled with a 100:1 harmonic drive, this combination provides a 670:1 gear reduction from the motor to the capstan. In another embodiment, a brush-type DC motor is used. Power for the DC motors mentioned above can be from a battery pack mounted on the ascender, mounted on the operator or both. Power can also be transmitted from a remote power source through a cable coupled to power ascender 10. In one aspect of the above embodiments, the motor is equipped with reduction gears coupled to the shaft output. In another aspect of the above embodiments (not shown), the axis of the motor is mounted at 90 degrees to the axis of the capstan and a worm gear or gear box is used.

In another embodiment, AC power is supplied by cable and an AC motor is used. In one mode of this embodiment, the AC motor is 3 phase.

In a further embodiment of the invention (not shown) motor 104 is a compressed gas turbine powered by compressed air. In one mode of this embodiment, motor 104 is a 2.5 inch diameter aluminum impulse turbine, turning at 50,000 rpm. The turbine is driven by compressed gas at 150 psig and develops approximately 2.5 hp. The output of the turbine has a 4.2:1 primary reduction ratio.

In one aspect of this embodiment, compressed gas is carried on the ascender or by the operator in a compressed gas tank. In another aspect of this embodiment, compressed gas is provided through a hose from a remote source such as a tank or compressor. In a still further aspect of the invention (not shown), a gas generator such as a chemical cartridge or solid propellant gas cartridge is activated to power the compressed gas turbine.

In a further embodiment of the invention (not shown), motor 104 is an internal combustion engine. In one mode of this embodiment, motor 104 is a two-stroke gasoline engine. In a still further embodiment of the invention (not shown), motor 104 is coupled to powered rope ascender 10 through a cable drive system.

Figure 10:
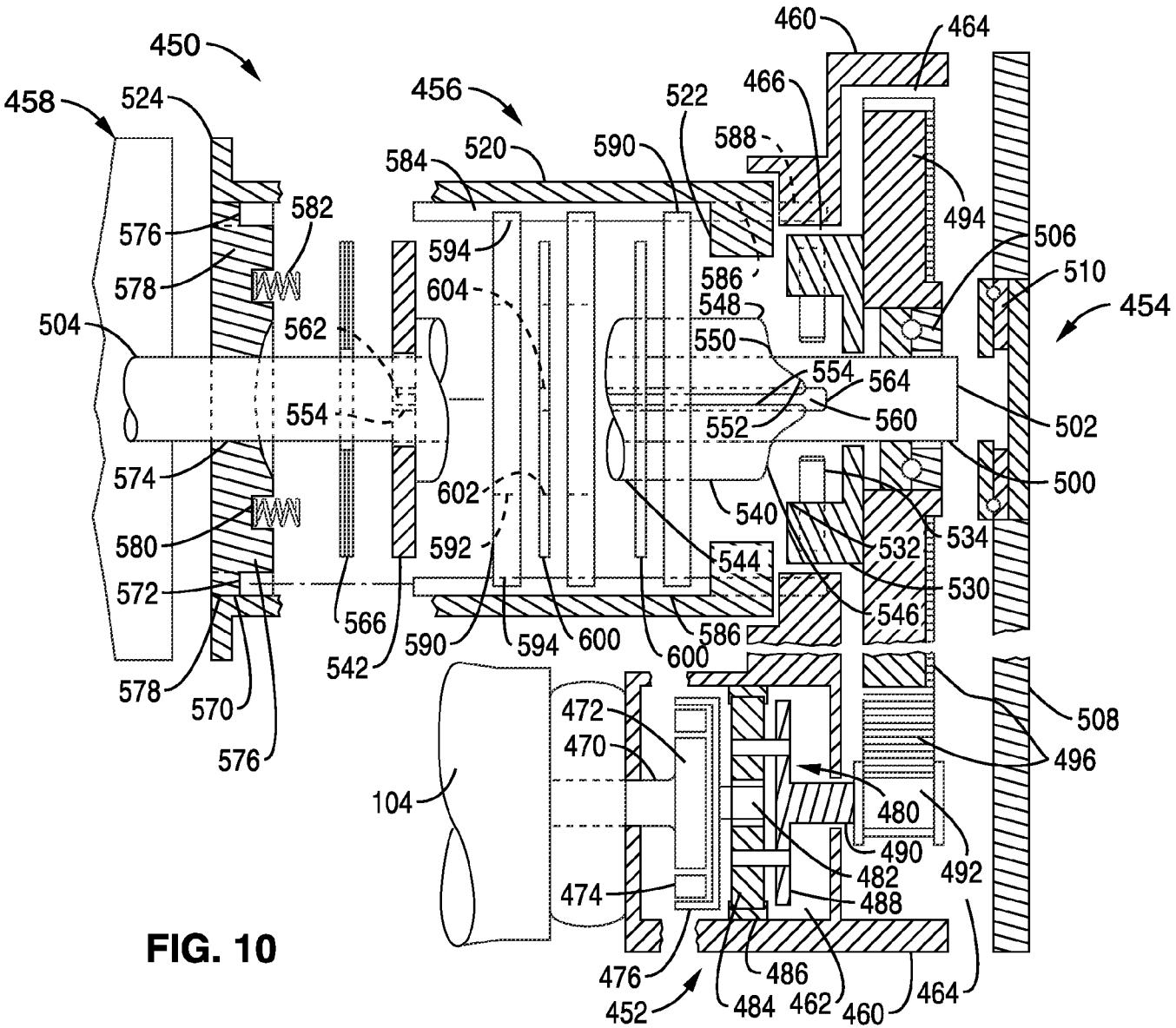
FIG. 10 is an exploded section view of another embodiment of a drive train assembly for a powered rope ascender as shown in FIG. 1 with a motion activated brake.

FIG. 10 is an exploded section view of another embodiment of a drive system for a powered rope ascender designated ascender drive system 450. Ascender drive system 450 is configured to prevent backdrive through the capstan and is typically used on a larger powered rope ascender adapted to ascend with about a 500 pound load up to about a 1000 pound load. Ascender drive system 450 consists of four primary assemblies; a motor clutch assembly 452, a belt drive assembly 454, a motion actuated brake assembly 456 and a gear reduction assembly 458. Gear reduction assembly 458 will be described in more detail in FIG. 11.

In FIG. 10, drive housing 460 has clutch chamber 462 and belt housing chamber 464. Below belt housing chamber 464 is yoke chamber 466. Clutch chamber 462 couples to motor 104. Drive housing 460 is made from aluminum or other durable lightweight material. Motor input shaft 470 enters clutch chamber 462 and couples to clutch shoe drive plate 472 which supports clutch shoes 474 within clutch drum 476. In one embodiment, when motor input shaft 470 reaches about 6200 rpm, clutch shoes 474 engage clutch drum 476.

Clutch drum 476 is coupled to a planetary drive unit 480 which consists of sun gear 482, planet gears 484, ring gear 486 coupled to drive housing 460 and planet gear carrier 488. The output from clutch drum 476 is transmitted through sun gear 482 and out planet gear carrier 488. In one embodiment, planet gear unit 480 provides a reduction ratio of about 6:1. In other embodiments, planet gear unit 480 provides about a 2:1 to about a 20:1 gear reduction ratio. In a further preferred embodiment, a planetary drive unit is not used in this location and clutch drum 476 is coupled directly to shaft 490.

Shaft 490 coupled to planet gear unit 480 extends upward into belt housing chamber 464. Drive sprocket 492 is coupled to shaft 490 and configured to drive driven sprocket 494 with a cogged timing belt 496. In one embodiment, a gear reduction of about 4:1 is achieved with drive sprocket 492 and driven sprocket 494. In further embodiments gear reductions of about 2:1 up to about 10:1 are used. Drive sprocket 492 and driven sprocket 494 are configured to rotate in either direction based on the rotational output from motor 104. Other mechanical transmissions such as chain drives, gears or rotating shafts with universal joints are less preferable but may be used for belt drive assembly 454 without departing from the teachings of the invention.

Spindle shaft 500 has proximal end 502, positioned in belt housing chamber 464 and extends through yoke housing chamber 466 and to gear reduction assembly 458 at distal end 504. Spindle shaft 500 is coupled to driven sprocket 494 with a bearing 506 near proximal end 502. Driven sprocket 494 can rotate freely on spindle shaft 500 through bearing 506. A belt drive housing cover 508 is configured to cover belt housing chamber 464 and to support bearing 510 over driven sprocket 494. Bearing 510 receives the proximal end 502 of spindle shaft 500 and is adapted to react to axial thrust loads transmitted through the hub of driven sprocket 494 as will be described shortly.

Figure 11:
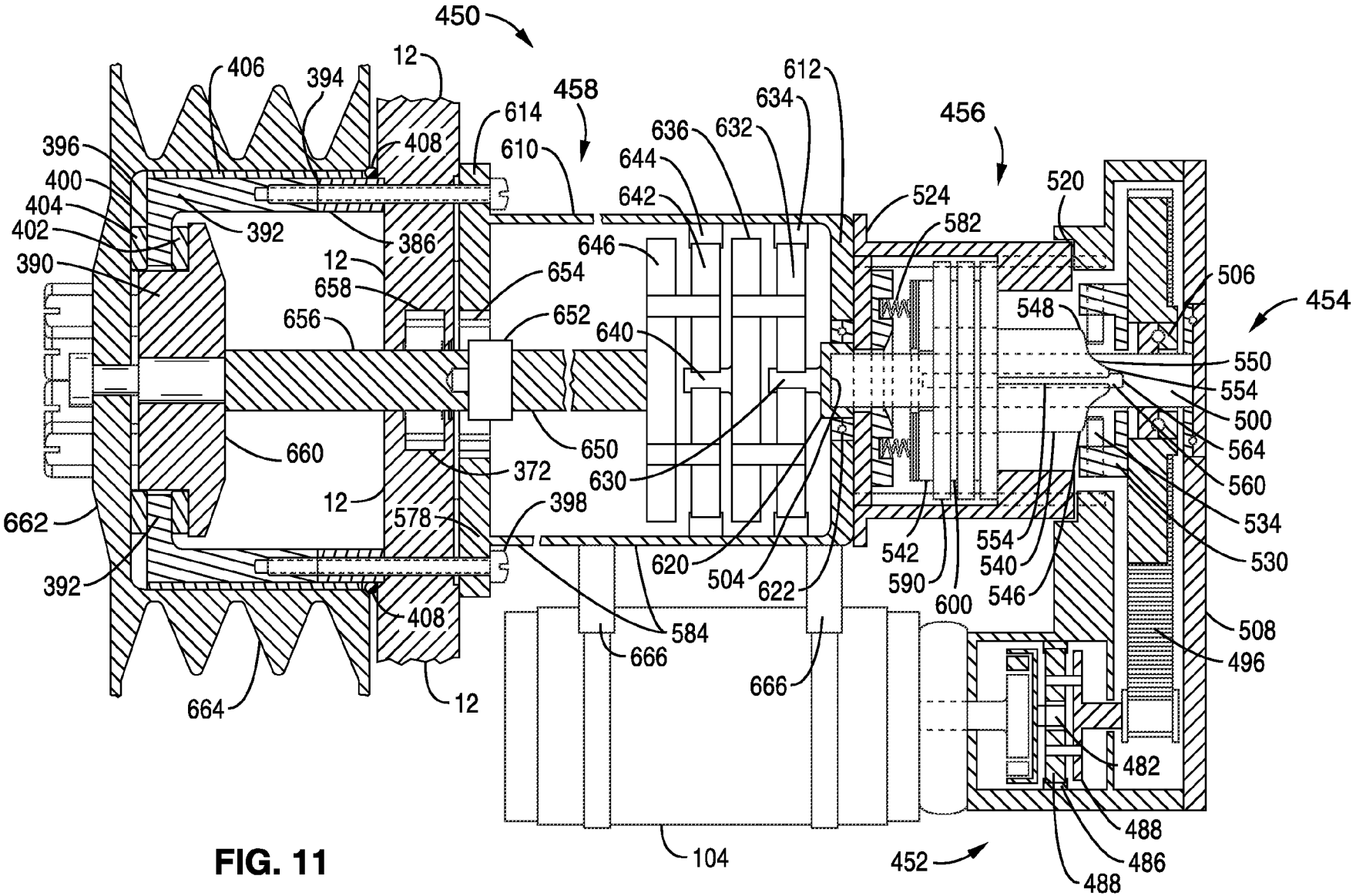
FIG. 11 is a cross section view of the drive train assembly shown in FIG. 10 attached to the capstan.

Motion actuated brake assembly 456 has brake housing 520 that has thrust shoulder 522 that couples to drive housing 460 at yoke housing chamber 466 and has housing base 524 that couples to a gear reduction assembly 458 (described in FIG. 11). In one embodiment, brake housing 520 is cylindrical with an inside diameter of about 2½ inches.

Coupled to driven sprocket 494 is yoke 530 that extends down into yoke chamber 466. In one embodiment, driven sprocket 494 and yoke 530 are cast or milled from a single workpiece. Yoke 530 consists of two crescent structures 532 with the outer chord configured to rotate within yoke chamber 466. Each crescent structure 532 supports a cam lug 534 mounted perpendicular to spindle shaft 500 and positioned to extend inward toward, but not touching, spindle shaft 500. In one embodiment, cam lugs 534 are held in place by force fit, split rings, set screws or other fastening means known in the art. In the preferred embodiment, cam lugs 534 are each supported by two ball bearings. Needle bearings or other low friction surfaces may also be used.

Brake spindle 540 is coupled to spindle shaft 500 with a shaft key and sliding keyway in spindle 540 (not shown for clarity). Splines or other sliding couplings that will transmit rotational force but allow axial movement may also be used. Brake spindle 540 has spindle base 542, spindle barrel 544 and throwout cam 546 on the top circumference of spindle barrel 544. Spindle barrel 544 is sized to fit between the crescents of yoke 530. Throwout cam 546 has two opposing protrusions that are defined by cam flats 548, cam ramps 550 and cam crests 552. In one embodiment, throwout cam 546 is configured on both sides as a uniformly accelerated and retarded motion profile cam. In further embodiments, cam ramps 550 have non-uniform profiles. In other embodiments, the profiles of opposing cam ramps 550 are different from each other. Throwout cam 546 reacts with sliding or rolling contact to cam lugs 534.

Spindle barrel 544 has two vertical cut outs 554 (one shown for clarity) with C shaped cross sections that extend from cam crests 552 through spindle base 542. Two pilot pins 560 (one shown for clarity) are positioned in cut outs 554 and have distal end 562 that extends through spindle base 542 and proximal end 564 that extends above cam crest 552. The circumference of pilot pins 560 extend outward through the opening in the C shaped profile past the circumference of spindle barrel 544 when positioned in cut out 554. Proximal end 564 of pilot pins 560 are positioned to react with cam lugs 534 when driven sprocket 494 is rotated past cam crests 552 in either direction.

Coupled to the bottom of spindle base 542 is thrust bearing 566, which in an exemplary embodiment, is a needle bearing. Positioned below thrust bearing 566 is spring plate 570. Spring plate 570 has flange 572 with a circumference that fits within brake housing 520. Flange 572 has a center hole 574 that accommodates rotating spindle shaft 500 and has two cutouts 576 on the circumference of flange 572 and positioned 180 degrees apart. Above flange 572 is spring plate body 578 with evenly spaced spring bores 580 facing thrust bearing 566. In one embodiment, spring plate body 578 has 12 evenly spaced spring bores 580. Compression springs 582 are positioned in spring bores 580 and configured to react with the bottom face of thrust bearing 566. In another preferred embodiment, spring bores 580 are on the opposite side of spring plate 570 and react with the face of gear reducer 458 to force spring plate 570 against bearing 566.

Cut outs 576 in the circumference of spring plate flange 572 accommodate two stationary brake pins 584 that extend along the interior wall of brake housing 520 and through bores 586 in thrust shoulder 522 of brake housing 520. In operation, spring plate 570 is held stationary by brake pins 584 and does not rotate. In an exemplary embodiment, brake pins 584 extend into bores 588 in drive housing 460. Note that more than 2 brake pins 584 with the same number of cutouts in the mating parts may be used.

Mounted on spindle base 542 is at least one brake plate 590. Brake plate 590 has center hole 592 and two opposing cutouts 594 on the circumference. Center hole 592 is configured to allow spindle barrel 540 with pilot pins 560 inserted to rotate freely. Circumference cutouts 594 are positioned to fit in stationary brake pins 584 so that brake plate 590 is held stationary and will not rotate. In an exemplary embodiment, there are three brake plates 590 mounted on spindle barrel 544 and each brake plate 590 is about 2½ inches in diameter and made of sintered bronze. Note that the top brake plate 590 is positioned with the top surface to react with thrust shoulder 522 of brake housing 520. Between each adjacent two brake plates 590 is a spindle plate 600. Each spindle plate 600 has a center hole 602 that fits over spindle barrel 544. Center hole 602 has two cutouts 604 (one shown for clarity) that accommodate pilot pins 560 when mounted on spindle barrel 540. Thus spindle plates 600 are fixed by pilot pins 560 to rotate with spindle 540. In an exemplary embodiment, spindle plates 600 are about 2 inches in diameter.

When there is no rotation of driven sprocket 494, cam lugs 534 rest against cam flat 548. Springs 582 force spindle base 542 upward so that brake plates 590 and spindle plates 600 are compressed together between spindle base 542 and thrust shoulder 522 of brake housing 520 in a braking state. The compressed plate surfaces generate sufficient friction to prevent spindle 540 from turning in reaction to rotational force exerted on distal end 504 of shaft 500, such as from rotation of the capstan in reaction to a heavy load through the rope.

When driven sprocket 494 rotates in either direction, cam lugs 534 react on throwout cam 546 by following throwout cam 546 from cam flat 548 to cam crest 552. Because driven sprocket 494 and cam lugs 534 are constrained axially by bearing 510, spindle 540 slides downward against thrust bearing 566 which reacts with springs 582. This downward axial motion of spindle 540 removes compressive friction forces on the surfaces of brake plates 590 and spindle plates 600 to allow spindle 540 to rotate with minimal or no friction. As driven sprocket 494 continues to rotate cam lugs 534 travel to cam crests 552 and react against pilot pins 560. When cam lugs contact pilot pins 560, spindle 540 and shaft 500 rotate at the same speed as driven sprocket 494. Motor 104 now drives through motion actuated brake assembly in a driving state.

When driven sprocket 494 stops rotation, springs 582 push axially upward and cause spindle 540 to seek a position with cam lugs 534 resting on cam flat 548 and brake plates 590 compressed against spindle plates 600 in a braking state.

Because motion activated brake assembly 456 resists being back driven with rotational force through distal end 504 of shaft 500, shaft 500 resists turning in either direction with the motor 104 de-energized. Motor 104 must be energized with cam lugs 534 on driven sprocket 494 rotating spindle 540 in a driving state to turn shaft 500. In another embodiment, a sprag type no-back clutch is used in place of the motion activated brake.

FIG. 11 is a cross section view of drive system 450 shown in FIG. 10 installed on a powered rope ascender. Some part numbers for motor clutch assembly 452, belt drive assembly 454 and motion activated brake assembly 456, all described previously in FIG. 10, have been omitted for clarity. Some components are not illustrated in cut section for clarity.

In FIG. 11 gear assembly 458 has gear housing 610 with top plate 612 coupled to base 524 of brake housing 520 and base plate 614 coupled to base plate 12 (shown previously in FIG. 9). Distal end 504 of spindle shaft 500 enters through top plate 612 and couples to input shaft collar 620. Input shaft collar 620 is supported on bearing 622 which could be a ball bearing or tapered roller bearing. For heavy applications, such as ascending with a load of 500 or more pounds, a planetary gear drive is preferred for gear assembly 458. Input shaft collar 620 couples to first sun gear 630 which drives first planet gear 632 against first ring gear 634 coupled to gear housing 610. First planet carrier 636 is coupled to first planet gear 632 and second sun gear 640. Second sun gear 640 drives second planet gear 642 against second ring gear 644 coupled to gear housing 610. Second planet carrier 646 is coupled to second planet gear 642 and transmits the rotational output to output shaft 650. Output shaft 650 is coupled to output collar 652 which is supported in base plate 614 by bearing 654. In an exemplary embodiment, gear assembly 458 provides about a 40:1 gear reduction ratio. In further embodiments, drive assembly 450 provides from about a 10:1 up to about a 1000:1 gear reduction ratio. Gear drives with one, three or more planetary stages may be used in other configurations or to achieve lower or higher gear ratios. In some applications (not shown), a harmonic drive assembly (as shown in FIG. 9) is used alone or in combination with a gear assembly 458.

In the illustrated embodiment, output collar 652 is coupled to capstan shaft 656 which is supported in base plate 12 by bearing 658. Capstan shaft 656 is coupled to capstan spool 660 which is coupled directly to capstan 662. Capstan 662 is supported on base plate 12 as previously described in FIG. 9. Note that in this embodiment, the grooves 664 in capstan 662 are deeper and have a sharper V profile than the capstan drum 58 shown in FIG. 9. The deeper grooves 664 provide a beneficial grip on the rope when lifting heavier loads. In one embodiment, the deeper grooves on capstan 662 can maintain a load of up to about 1000 pounds on a ½ inch rope without slipping and without a pinch wheel engaged. For heavier lifting, a ½ inch rope with a firm core that resists deformation is preferable.

Two motor mounts 666 are shown coupling motor 104 to gear assembly 458. Motor mounts 666 can be in the form of bands, struts or brackets as known in the art.

Figure 12:
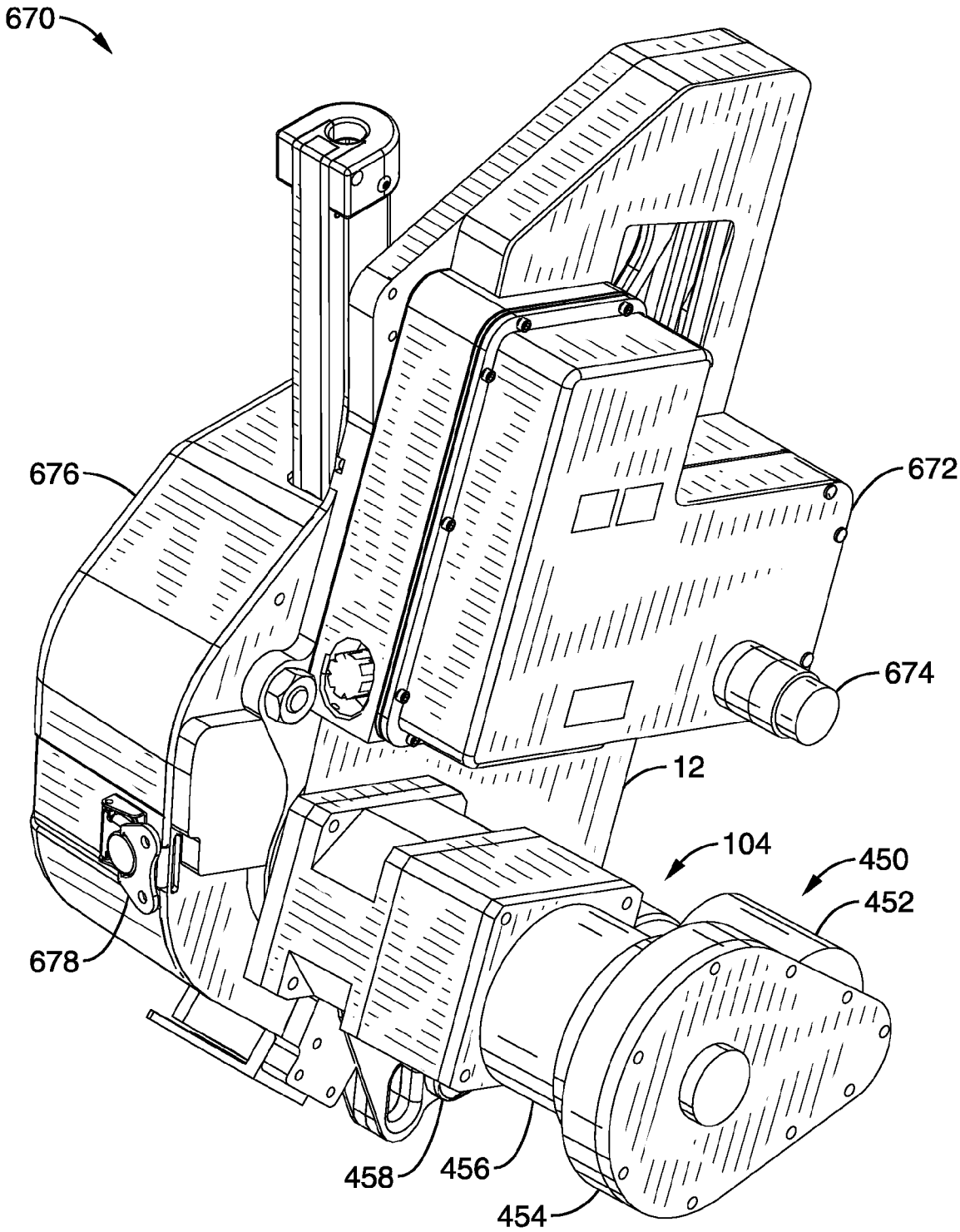
FIG. 12 is a perspective view of a powered rope ascender with the drive train assembly shown in FIG. 11 and FIG. 12.

FIG. 12 illustrates a perspective view of a powered personnel ascender 670 with a drive train 450 as shown previously in FIG. 10 and FIG. 11. Motor 104 is mounted on gear assembly 458 and is coupled to motor clutch assembly 452. Belt drive assembly 454 is mounted on motor clutch assembly 452 and motion activated brake assembly 456. Gear assembly 458 is mounted to base plate 12. A controls enclosure 672 is shown with electrical plug 674 for connection to a power supply such as a battery pack or electrical cable. Capstan housing 676 covers the capstan and rollers and is secured with housing key 678.

In one embodiment, powered personnel ascender 670 has a lifting capacity of about 500 pounds net or about 550 pounds gross (including battery pack and ascender). It has a hold on line capacity of about 1000 pounds net or about 1050 pounds gross. It uses a battery back (not shown) that provides about 36 Volts DC and the DC brushless motor 104 draws about 30 amps maximum. In this configuration, powered rope ascender can ascend at loaded capacity at about 36 feet per minute for about 500 vertical feet per battery charge. The total gear reduction in powered personnel ascender 670 with drive train 450 is about 1000:1. Thus a motor 104 turning at about 40,000 rpm will rotate a capstan drum about 40 rpm.

Figure 13A:
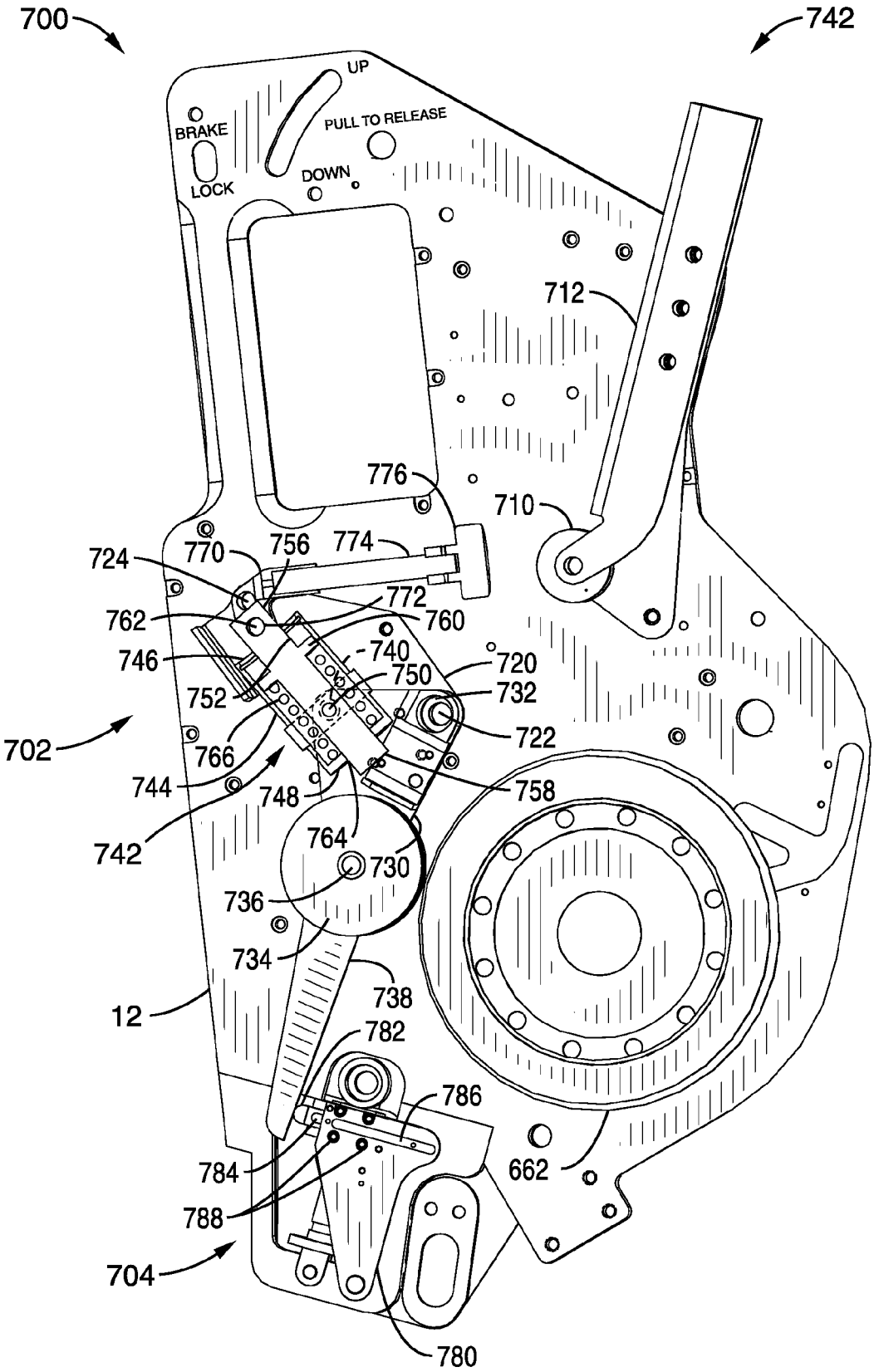
FIG. 13A is a perspective view of another embodiment of a powered rope ascender with a spring loaded pinch roller in the closed position.
Figure 13B:
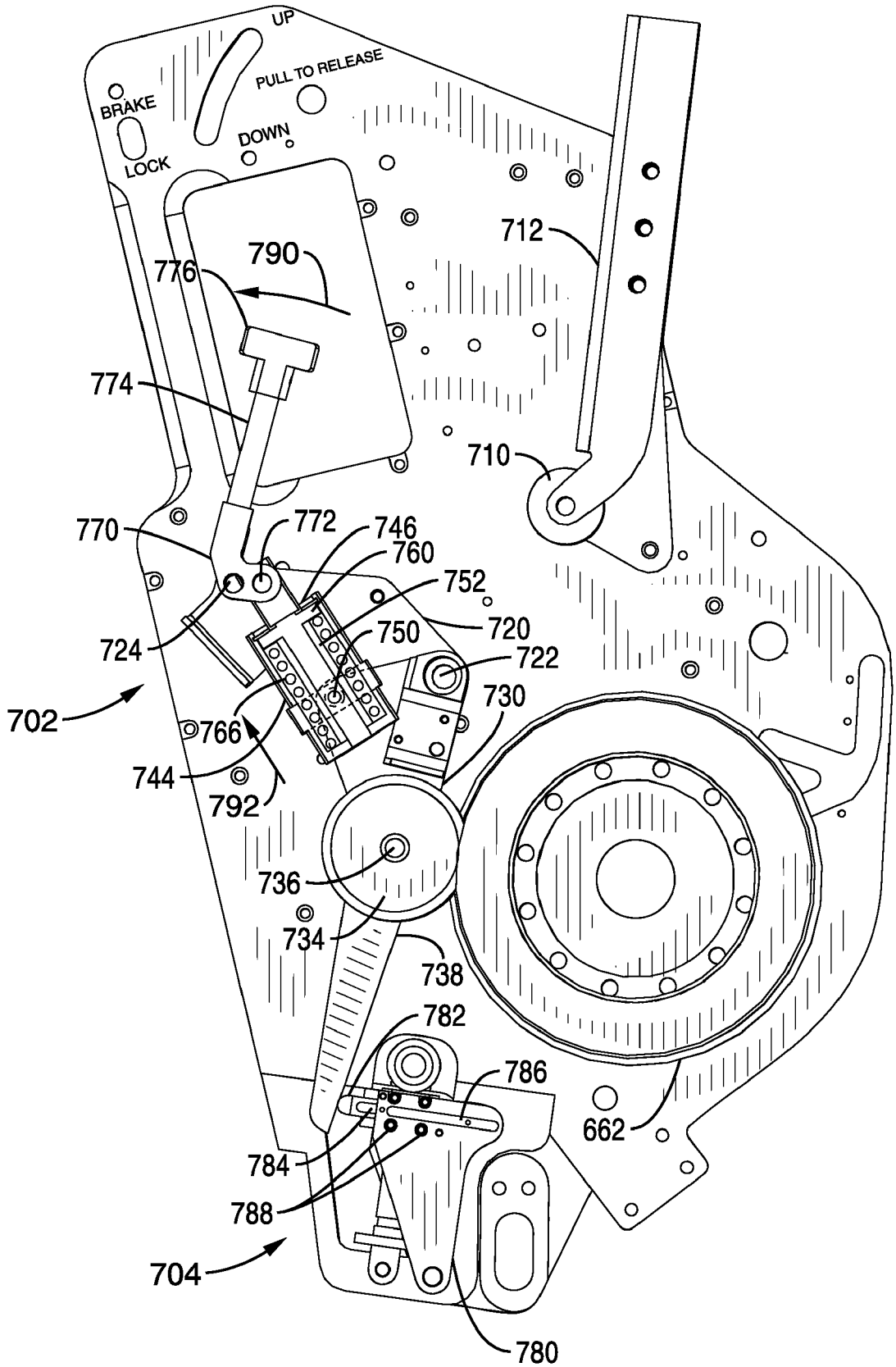
FIG. 13B is a perspective view of the spring loaded pinch roller shown in FIG. 13A in an intermediate position.
Figure 13C:
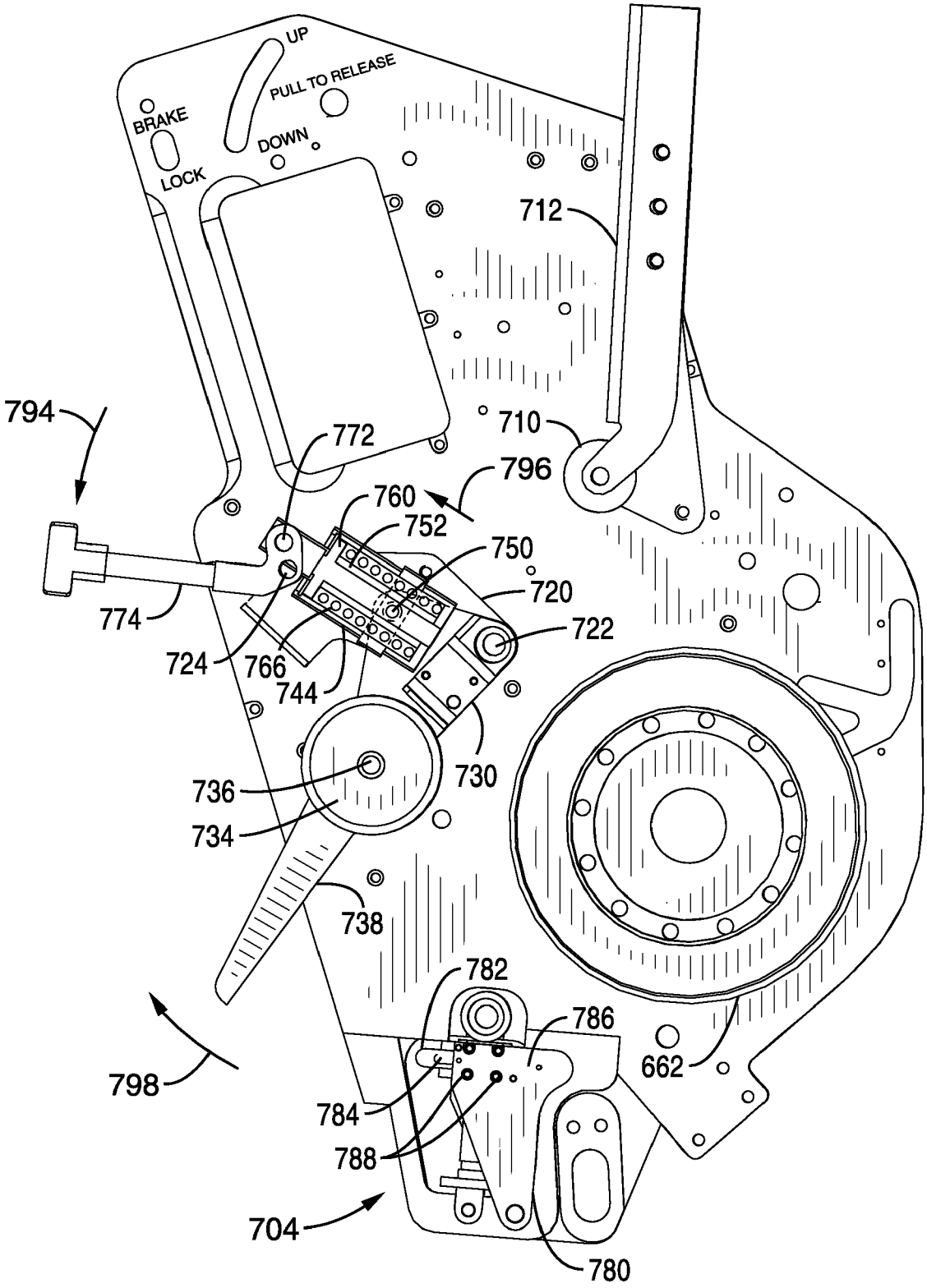
FIG. 13C is a perspective view of the spring loaded pinch roller shown in FIG. 13A in an open position.

FIG. 13A through FIG. 13C illustrate partial cross section views of a powered personnel ascender 700 with a spring loaded pinch roller assembly, designated 702, and an adjustable load limit assembly designated 704. In the cross section portion, plates, pins and fasteners on top of spring loaded pinch roller assembly 702 have been omitted for clarity.

Referring to FIG. 13A, fixed position guide roller 710 is coupled base plate 12 and below up channel guide 712 to guide the rope between spring loaded pinch roller assembly 702 and capstan 662. Spring loaded pinch roller assembly 702 is shown in the closed position and has pinch roller mounting bracket 720 coupled to base plate 12. Pinch roller mounting bracket 720 has pinch roller pivot pin 722 and toggle pivot pin 724. A pinch roller pivot plate 730 is coupled to pinch roller mounting bracket 720 and has an aperture 732 configured to articulate about pinch roller pivot pin 722. Pinch roller pivot plate 730 has pinch roller 734 mounted on pinch roller pin 736 and tension arm lever 738 that extends down to adjustable load limit assembly 704. Pinch roller 734 is positioned to pinch a rope wrapped on capstan 662. Plunger pivot 740 is positioned on pinch roller pivot plate 730 offset from a line between pinch roller pivot pin 722 and pinch roller pin 736 such that movement of plunger pivot 740 relative to pinch roller pivot pin 722 will move pinch roller 734 relative to capstan drum 662 as will be discussed in FIG. 13C.

Plunger assembly 742 has spring barrel 744 with proximal end cap 746, distal end cap 748 and load pin 750 on spring barrel 744 between proximal, distal end caps 746, 748 that couples to plunger pivot 740. A mating plunger pivot and load pin on top of spring barrel 744 are not shown in this section view for clarity.

Inside spring barrel 744 is plunger 752 with proximal end 756, distal end 758 and flange 760 between proximal, distal ends 756, 758. End caps 746, 748 have apertures 762, 764 respectively adapted to receive proximal, distal ends 756, 758 of plunger 752. Positioned between distal end cap 748 and plunger flange 760 is compression spring 766.

Toggle 770 is coupled to pinch roller mounting bracket 720 at toggle pivot pin 724 and configured to interact with plunger assembly 742. Toggle 770 is coupled to proximal end 756 of plunger 752 at plunger pivot 772. A toggle lever 774 is coupled to toggle 770 to articulate toggle 770 about toggle pivot pin 724. A toggle knob 776 is positioned at the end of toggle lever 774 for grasping.

FIG. 13A shows spring loaded pinch roller assembly 702 in a closed position. Plunger pivot 772 of toggle 770 reacts against spring barrel 744 through plunger flange 760 against compression spring 766 which keeps toggle 770 in a closed position. Plunger flange 760 reacts against distal end cap 748 of spring barrel 744. Load pin 750 of spring barrel 744 is urged to the right urging pinch roller 734 against the rope on capstan 662.

Also shown in FIG. 13A is an adjustable load limit assembly 704 that has pivot support bracket 780 that supports adjustable tension arm reaction pin 782. Tension arm reaction pin 782 has slot 784 that slides in slide key 786 in pivot support bracket 780. Once tension arm reaction pin is in the desired position, set screws 788 are used to secure tension arm reaction pin 782 to pivot support bracket 780. The position of adjustable tension arm reaction pin 782 can be changed to compensate for different rope characteristics or calibration of plunger assembly 742. Note that any reaction against tension arm lever 738 by load limit assembly 704 causes spring barrel 744 to react through compression spring 766 against plunger 752 and urges pinch roller 734 away from capstan 662.

FIG. 13B is a partial cross section view of the spring loaded pinch roller assembly 702 shown previously in FIG. 13A in an intermediate position. Toggle 770 has been rotated about a quarter turn counter-clockwise by rotation of toggle lever 774 as shown by arrow 790. Flange 760 of plunger 752 travels proximally and is positioned against proximal end cap 746 of spring barrel 744 as shown by arrow 792. In this position, the force of compression spring 766 is released and the pinching force of pinch roller 734 against the rope on capstan 662 is removed.

FIG. 13C is a partial cross section view of the spring loaded pinch roller assembly 702 shown previously in FIG. 13B in an open position. Toggle lever 774 has been rotated about another quarter turn counter clockwise as shown by arrow 794 so that toggle 770 is rotated about toggle pivot pin 724. Counter clockwise movement of plunger pivot 772 urges spring barrel 744 to the left as indicated by arrow 796. Movement of load pin 750 of spring barrel 744 to the left causes pinch roller pivot plate 730 to rotate about pinch roller pivot pin 722 in a clockwise direction as indicated by arrow 798. This positions pinch roller 734 away from capstan 662 and allows access to the rope for threading, adjustment or removal. In one embodiment, a hinged housing (similar to 676 shown in FIG. 12) covers spring loaded pinch roller assembly 702 and capstan 662 and is opened to access toggle lever 774 and move it to an open position. Further, the hinged housing cannot not be closed until toggle lever 774 is in the closed position as shown in FIG. 13A. In other embodiments, a switch is coupled to the housing to prevent motor activation with the housing open.

Figure 14:
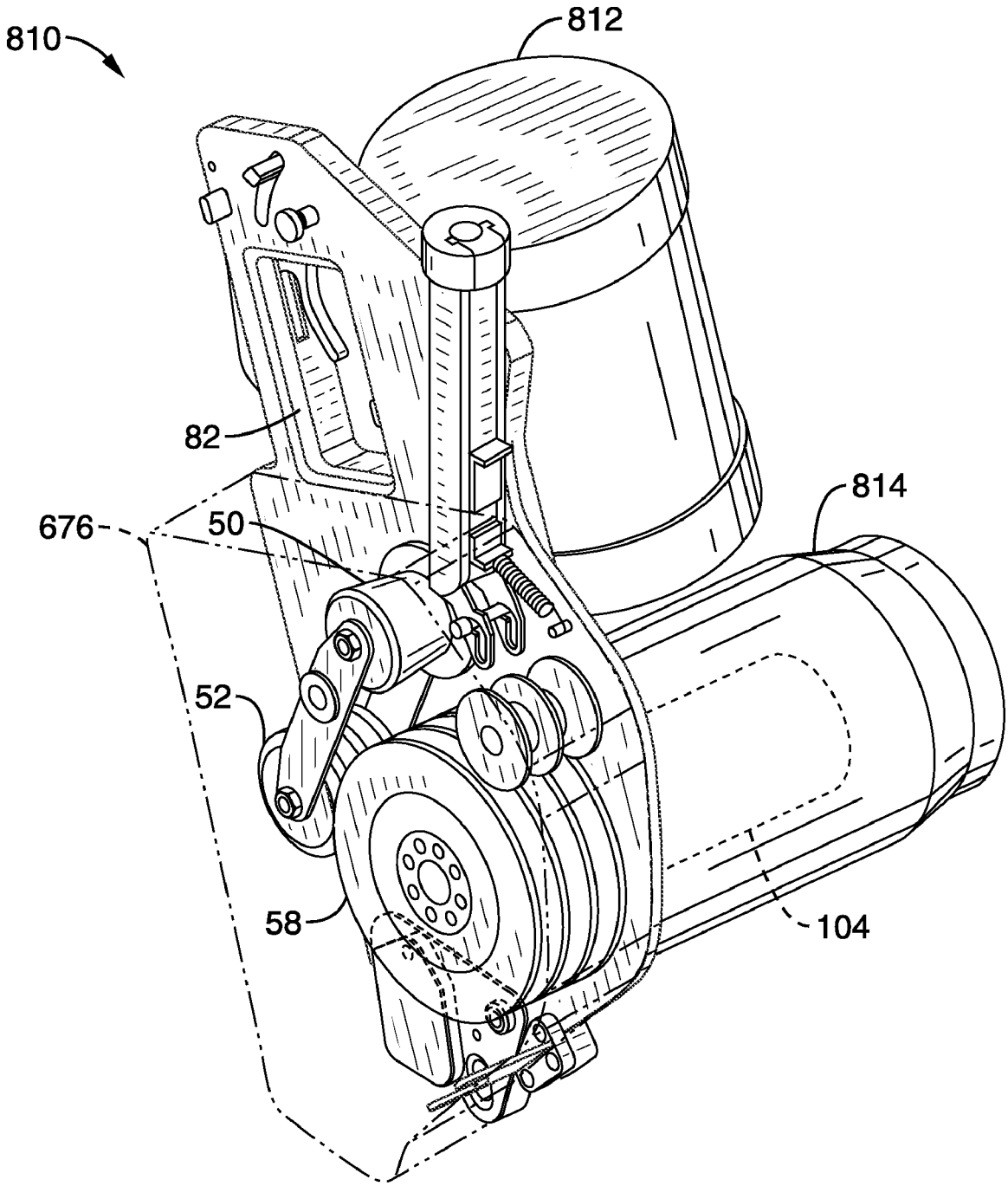
FIG. 14 is a schematic perspective view of a powered rope ascender as shown in FIG. 1 with an integrated motor enclosure and battery enclosure for use in explosive conditions.

FIG. 14 illustrates an embodiment of a powered personnel ascender designated 810 configured for use in an explosive environment. Battery enclosure 812 is coupled to base plate 12 and also encloses associated circuits and controls. Motor enclosure 814 is coupled to base plate 12 to enclose motor 104 and associated electrical connections. A capstan housing 676 (shown previously in FIG. 12) is illustrated in phantom covering capstan drum 58 and tension roller 50 and pinch roller 52 during use. Other embodiments of powered personnel ascenders such as shown in FIG. 12 and in FIG. 13A can be used with battery enclosure 812 and motor enclosure 814.

In one embodiment, the batteries, high current connections, controls and electrical circuits (not shown) are enclosed in sealed battery enclosure 812. The motor 104 and associated circuits are enclosed in sealed motor enclosure 814. There is a connecting plate or conduit between battery enclosure 812 and motor enclosure 814 (not shown) that encloses the current carrying conductors and controls, preferably using potting or other sealing means. The batteries and associated cables inside battery enclosure 812 cannot be accessed when battery enclosure 812 is sealed, and there are no exposed cables or conductors outside of battery enclosure 812 and motor enclosure 814 that can be disconnected or severed. Service to batteries or the motor would have to take place outside an explosive environment.

In an exemplary embodiment, openings in battery enclosure 812 and motor enclosure 814 have mechanical seals that provide a close fit between mating surfaces. In one variation, shaft seals are close fitting with a 0.001 inch or less clearance and a length equal to or greater than the diameter. In another variation, threaded connections with at least a 5 thread engagement are used. In a further variation, the end caps of battery enclosure 812 and motor enclosure 814 are sealed with close tolerance mating threads. In a further exemplary embodiment, the total free volume of battery enclosure 812 and motor enclosure 814 combined is about 100 cc or less. In a still further embodiment (not shown), battery enclosure 812 and motor enclosure 814 have flame arresting vent plugs.

In another embodiment, battery enclosure 812 and motor enclosure 814 are rated for use in Class 1, Division 1, Groups B,C, and D explosive gaseous atmospheres as defined by the Canadian Standards Association and configured to withstand the pressure and combustion products associated with the burning of selected fuel air mixtures. For example Group B is a fuel air mixture of 32% Hydrogen (2.8% stoichiometric) that generates a flame temperature of 1,000 degrees Fahrenheit and a pressure of 27 psig. The molecular weight of the combustion products is about 6 which is very light. Group C is a fuel air mixture of 8% Ethylene (8% stoichiometric) that generates a flame temperature of about 3,704 degrees Fahrenheit and a pressure of 105 psig. The molecular weight of the combustion products is about 27.4 which is heavy. Group D is a fuel air mixture of 4.6% Propane (6.5% stoichiometric) that generates a flame temperature of about 3,100 degrees Fahrenheit and a pressure of about 87 psig. The molecular weight of the combustion products is about 28.5 which is heavy.

Other means known in the art for providing explosion proof enclosures for the batteries, power circuits, controls and motors may be used without departing from the teachings of the invention.

Figure 15:
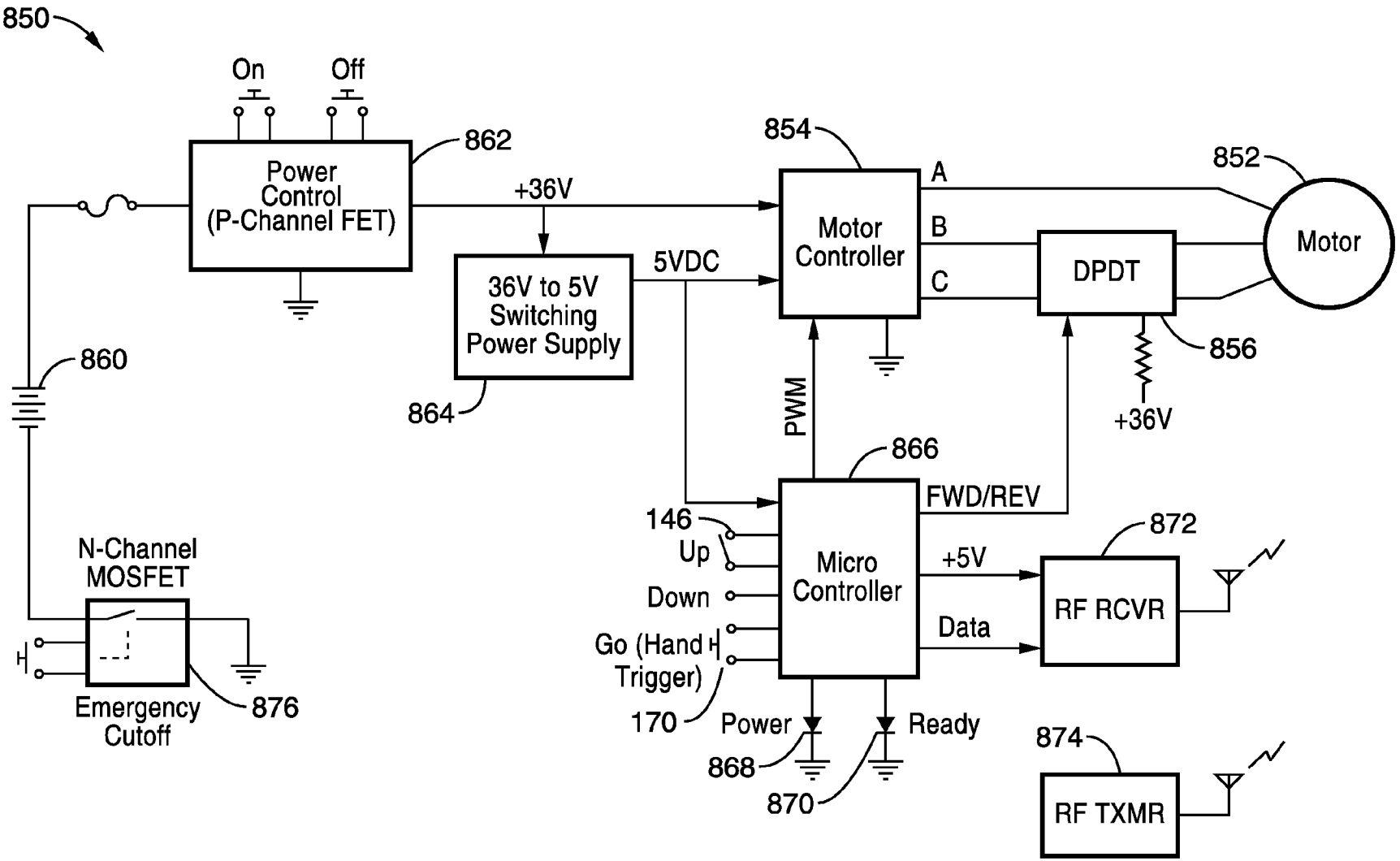
FIG. 15 is a schematic diagram of a control system to operate a powered rope ascender as shown in FIG. 1 through FIG. 14.

FIG. 15 illustrates a schematic controls diagram designated 850 for control of a powered personnel ascender. In this illustration, a 3 phase motor 852 is shown controlled by motor controller 854 but other motor/controller combinations can be used, such as for a DC motor. In the illustrated variation, DPDT switch 856 is used to reverse rotation of motor 852. In another variation, DPDT switch 856 is replaced by circuitry in motor controller 854. Power for motor 852 comes from 36 volt battery 860 through power control switch 862 which is a P-Channel FET. Power supply 864 provides control circuit power at about 5 volts DC to motor controller 854 and a micro controller 866.

Microcontroller 866 performs a number of control operations. First it performs an initial start up check of controls and systems before recognizing input signals. Second, it receives primary input from the hand controls including the up/down switch 146 (shown in FIG. 1) and motor activation switch 170. Microcontroller 866 translates these inputs to control signals to motor controller 854 and DPDT switch 856, preferably through pulse width modulation. Microcontroller 866 also monitors the status of a number of sensors (not shown) such as battery voltage or status of capstan cover, and provides output to status indicators such as a power LED 868 and a ready LED 870 to indicate operational status.

In a further embodiment, control system 850 is configured for remote operation. A remote receiver 872 is connected to microcontroller 866 to receive input signals from remote transmitter 874. Remote transmitter 874 is configured to send signals for basic operations such as up/down, brake position and/or motor speed. In a preferred mode, the signals between remote transmitter 874 and remote receiver 872 that are electronic transmissions digitally encoded or use frequency hopping to prevent interference with adjacent devices or other transmission sources. In another mode, remote transmitter 874 is connected to remote receiver 872 by signal cable, fiber optic cable or use line of sight optical signals. In one mode of this embodiment, manual input from up/down switch 146 or motor activation switch 170 overrides signals from remote receiver 872.

In a still further embodiment of the invention, an N-Channel MOSFET emergency switch 876 is connected in the ground circuit of battery 860 and performs as an emergency shut off switch. Once activated, power from battery 860 to emergency switch 876 must be disconnected to reset the switch and restore power to the system. Emergency switch 876 can be configured for activation by several modes including manually by the operator on the powered ascender, remotely by signal cable, pull line or optical signal, by sensor signal such as speed, acceleration or temperature, or by an encoded signal from remote transmitter 874. It is to be appreciated that emergency switch 876 can be implemented in other modes such as at the connection to motor controller 854 or with the ground to power supply 864 remaining connected to battery 860 or with a timed or manualreset feature.

In an exemplary embodiment, the components of control system 850 are enclosed in explosion proof enclosures as described in FIG. 14. Remote transmitter 874 is also configured for safe use in a potential explosive environment.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. An apparatus for maneuvering on a rope while supporting a load comprising:

a base plate;

means for engaging a rope;

wherein said means for engaging a rope is coupled to said base plate;

wherein said means for engaging a rope is configured to grip the rope;

a motor coupled to base plate;

wherein said motor is adapted to propel said means for engaging a rope relative to the rope; and means for limiting load;

wherein said means for limiting load is coupled to said base plate;

wherein said means for limiting load is configured to be coupled to a load; and wherein said means for limiting load is configured to reduce the grip on the rope by said means for engaging a rope when the load coupled to said means for limiting load exceeds a predetermined amount.

2. An apparatus as recited in claim 1, further comprising a motor selected from the group consisting essentially of a DC motor, an AC motor, a brushless motor, a compressed gas turbine, and an internal combustion engine.

3. An apparatus as recited in claim 1, wherein said means for engaging a rope comprises:

a capstan drum coupled to said motor;

a tension roller bracket having distal and proximal ends and a pivot point between said distal and proximal ends;

said tension roller bracket coupled to said base plate at said pivot point;

a tension roller coupled to said distal end of said tension roller bracket; and a pinch roller coupled to said proximal end of said tension roller bracket;

wherein said pinch roller is positioned to contact said capstan drum.

4. An apparatus as recited in claim 3:

wherein when a load is supported on said means for limiting load;

wherein said tension roller is configured to contact an upper region of rope that has at least one wrap of rope on said capstan drum; and wherein said pinch roller is configured to simultaneously apply a gripping force against said at least one wrap of rope on said capstan drum.

5. An apparatus as recited in claim 1, wherein said means for engaging a rope comprises:

a capstan drum coupled to said motor; and a pinch roller coupled to said base plate and further coupled to said means for limiting load;

said pinch roller having a closed position and an open position;

wherein in said closed position, said pinch roller is adapted to grip at least one wrap of rope on said capstan drum; and wherein in said open position, said pinch roller does not contact said at least one wrap of rope on said capstan drum.

6. An apparatus as recited in claim 3 or claim 5, wherein said means for engaging a rope further comprises:

an idler roller coupled to said base plate;

wherein said idler roller is positioned adjacent to said capstan drum;

wherein said capstan drum has a plurality of grooves;

wherein said idler roller has at least one groove; and wherein said idler roller is adapted to guide said at least one wrap of rope around said capstan drum.

7. An apparatus as recited in claim 6, further comprising:

a harmonic drive coupled between said capstan drum and said motor;

wherein said harmonic drive is adapted to reduce the rotation speed of said capstan drum relative to the rotation speed of said motor; and wherein said capstan drum can back drive said harmonic drive.

8. An apparatus as recited in claim 7, further comprising:

a brake coupled to said base plate;

a brake drum coupled between said harmonic drive and said motor;

wherein said brake drum has an inner and outer drum surface; and wherein said brake is adapted to engage said outer drum surface.

9. An apparatus as recited in claim 8, further comprising:

a centrifugal clutch mounted in said brake drum;

wherein said centrifugal clutch is coupled to said motor;

wherein said centrifugal clutch is adapted to engage said inner drum surface; and wherein said centrifugal clutch is adapted to reduce the starting torque required by said motor.

10. An apparatus as recited in claim 9, further comprising:

a trigger coupled to said base plate;

said trigger linked to said brake;

said trigger having first and second positions; and a motor controller linked to said trigger;

said motor controller adapted to energize said motor;

wherein when said trigger is in said first position, said brake is engaged with said outer drum surface and said motor is not energized by said motor controller; and wherein when said trigger is in said second position, said brake is disengaged from said outer drum surface and said motor is energized by said motor controller.

11. An apparatus as recited in claim 10, further comprising:

a receiver connected to said motor controller;

wherein said receiver is adapted to receive control signals to control said motor controller; and a remote transmitter adapted to send control signals to said receiver.

12. An apparatus as recited in claim 11:

wherein said trigger has a third position; and wherein when said trigger is in said third position, said brake is disengaged from said outer clutch drum surface and said motor is not energized by said motor controller.

13. An apparatus as recited in claim 12 further comprising:

a palm interlock coupled to said base plate;

said palm interlock adapted to react to palm pressure by an operator;

wherein said palm interlock is adapted to lock said trigger in said first position when no palm pressure is applied by said operator; and wherein said palm interlock is adapted to allow said trigger to move from said first position to said third and said second positions when palm pressure is applied to said palm interlock by said operator.

14. An apparatus as recited in claim 10, further comprising:

a palm interlock coupled to said base plate;

said palm interlock adapted to react to palm pressure by an operator;

wherein said palm interlock is adapted to lock said trigger in said first position when no palm pressure is applied by said operator; and wherein said palm interlock is adapted to allow said trigger to move to said second position when palm pressure is applied to said palm interlock by said operator.

15. An apparatus as recited in claim 6, further comprising:

a rotating yoke coupled to said motor;

a motion activated brake coupled between said rotating yoke and said capstan drum;

wherein said motion activated brake has a drive state and a brake state;

wherein said motion activated brake is in said drive state and rotates said capstan drum when said rotating yoke is rotating; and wherein said motion activated brake is in said brake state and prevents said capstan drum from rotating when said rotating yoke is stationary.

16. An apparatus as recited in claim 15, further comprising:

a trigger coupled to said base plate;

said trigger having first and second positions; and a motor controller linked to said trigger;

said motor controller adapted to energize said motor;

wherein when said trigger is in said first position, said motor is not energized by said motor controller and said motion activated brake is in said brake state; and wherein when said trigger is in said second position, said motor is energized by said motor controller and said brake is in said drive state.

17. An apparatus as recited in claim 16, further comprising:

a receiver connected to said motor controller;

wherein said receiver is adapted to receive control signals; and a remote transmitter adapted to send control signals to said receiver.

18. An apparatus as recited in claim 1, further comprising:

a motor enclosure coupled to said base plate adapted to enclose said motor;

a battery electrically connected to said motor; and a battery enclosure coupled to said base plate adapted to enclose said battery;

wherein said battery cannot be electrically disconnected from said motor when said motor is enclosed in said motor enclosure and said battery is enclosed in said battery enclosure.

19. An apparatus as recited in claim 1, wherein said means for limiting load comprises:

a tension arm having distal and proximal ends, said proximal end coupled to said means for engaging a rope;

wherein said distal end of said tension arm is adapted to move in a first direction;

wherein said means for engaging a rope is adapted to reduce the grip on the rope when said distal end of said tension arm is moved in said first direction;

a load bracket having a pivot dowel, a support dowel and a load aperture;

said load bracket coupled to said base plate at said pivot dowel;

a spring loaded support assembly coupled to said base plate;

said spring loaded support assembly adapted to support said load bracket at said support dowel;

wherein said spring loaded support assembly is adapted to react with said distal end of said tension arm; and wherein said spring loaded support assembly is adapted to move said distal end of said tension arm in said first direction thereby causing said means for engaging a rope to reduce the grip on the rope when the load supported in said load aperture exceeds a predetermined amount.

20. An apparatus as recited in claim 19, wherein said spring loaded support assembly comprises:

a pivot bracket having a pivot end and a roller support platform, said pivot end coupled to said base plate;

a spring support clevis having a clevis fork and a support rod, said clevis fork coupled to said base plate;

wherein said spring support clevis is positioned under said roller support platform;

a spring retainer having a distal end and a proximal end, said distal end having a bore adapted to fit over said support rod;

said proximal end of said spring retainer having a flange adapted to fit under said roller support platform;

a compression spring adapted to fit between said support clevis and said flange of said spring retainer;

a slot in said roller support platform;

a platen coupled to said flange of said spring retainer;

wherein said platen is adapted to extend through said slot in said roller support platform; and a roller coupled to said support dowel of said load bracket;

wherein said roller is adapted to be supported on said platen when the load supported in said load aperture is less than or equal to said predetermined amount; and wherein said roller is adapted to react with said roller support bracket thereby moving said distal end of said tension arm in said first direction causing said means for engaging a rope to reduce the grip on the rope when the load supported in said load aperture exceeds said predetermined amount.

21. An apparatus as recited in claim 19, wherein said roller support bracket is adjustable with respect to reaction with said distal end of said tension arm.

22. An apparatus for maneuvering on a rope while supporting a load, comprising:

a base plate;

a motor coupled to said base plate;

a capstan drum coupled to said motor;

wherein said motor is adapted to rotate said capstan drum;

wherein said capstan drum is adapted to receive at least one wrap of rope;

an upper rope guide coupled to said base plate and adapted to guide a rope to said capstan drum;

a pinch roller coupled to said base plate;

wherein said pinch roller is configured to apply a gripping force against said at least one wrap of rope on said capstan drum; and means for limiting load;

said means for limiting load coupled to said base plate;

wherein said means for limiting load is further adapted to couple to the load;

wherein said means for limiting load is adapted to react with said pinch roller; and wherein said means for limiting load is configured to reduce the gripping force by said pinch roller on said at least one wrap of rope on said capstan drum when the load exceeds a predetermined amount.

23. An apparatus as recited in claim 22, further comprising:

a tension roller bracket having distal and proximal ends and a pivot point between said distal and proximal ends;

wherein said pinch roller is coupled to said proximal end of said tension roller bracket;

wherein said tension roller bracket is coupled to said base plate at said pivot point; and a tension roller coupled to said distal end of said tension roller bracket;

wherein when a load is supported on said means for limiting load, said tension roller is configured to contact an upper region of rope between said upper rope guide and said capstan drum, and wherein said pinch roller is configured to simultaneously apply a gripping force against said at least one wrap of rope on said capstan drum.

24. An apparatus as recited in claim 22:

wherein said pinch roller has a closed position and an open position;

wherein in said closed position, said pinch roller is adapted to grip said at least wrap of rope on said capstan drum; and wherein in said open position, said pinch roller does not contact said at least one wrap of rope on said capstan drum.

25. An apparatus as recited in claim 22, further comprising:

a brake coupled to said base plate;

a brake drum coupled between said capstan drum and said motor;

wherein said brake drum has an inner and outer drum surface;

wherein said brake is adapted to engage said outer drum surface;

a centrifugal clutch mounted in said brake drum;

wherein said centrifugal clutch is coupled to said motor;

wherein said centrifugal clutch is adapted to engage said inner drum surface; and wherein said centrifugal clutch is adapted to reduce the starting torque required by said motor.

26. An apparatus as recited in claim 25, further comprising:

a trigger coupled to said base plate;

said trigger linked to said brake;

said trigger having first and second positions; and a motor controller linked to said trigger;

said motor controller adapted to energize said motor;

wherein when said trigger is in said first position, said brake is engaged with said outer drum surface and said motor is not energized by said motor controller; and wherein when said trigger is in said second position, said brake is disengaged from said outer drum surface and said motor is energized by said motor controller.

27. An apparatus as recited in claim 26, further comprising:

a palm interlock coupled to said base plate;

said palm interlock adapted to react to palm pressure by an operator;

wherein said palm interlock is adapted to lock said trigger in said first position when no palm pressure is applied by said operator; and wherein said palm interlock is adapted to allow said trigger to move to said second position when palm pressure is applied to said palm interlock by said operator.

28. An apparatus as recited in claim 27:

said trigger having a third position;

wherein when said trigger is in said third position, said brake is disengaged from said outer drum surface and said motor is not energized by said motor controller;

a palm interlock coupled to said base plate;

said palm interlock adapted to react to palm pressure by an operator;

wherein said palm interlock is adapted to lock said trigger in said third position when no palm pressure is applied by said operator; and wherein said palm interlock is adapted to allow said trigger to move from said third position to said first and said second positions when palm pressure is applied to said palm interlock by said operator.

29. An apparatus as recited in claim 22, further comprising:

a harmonic drive coupled between said capstan drum and said motor;

wherein said harmonic drive is adapted to reduce the rotation speed of said capstan drum relative to the rotation speed of said motor; and wherein said capstan drum can back drive said harmonic drive.

30. An apparatus as recited in claim 22, further comprising:

a rotating yoke coupled to said motor;

a motion activated brake coupled between said rotating yoke and said capstan drum;

wherein said motion activated brake has a drive state and a brake state;

wherein said motion activated brake is in said drive state and turns said capstan drum when said rotating yoke is rotating; and wherein said motion activated brake is in said brake state and prevents said capstan drum from rotating when said rotating yoke is stationary.

31. An apparatus as recited in claim 30, further comprising:

a trigger coupled to said base plate;

said trigger having first and second positions; and a motor controller linked to said trigger;

said motor controller adapted to energize said motor;

wherein when said trigger is in said first position, said motor is not energized by said motor controller and said motion activated brake is in said brake state; and wherein when said trigger is in said second position, said motor is energized by said motor controller and said brake is in said drive state.

32. An apparatus as recited in claim 31, further comprising:

a receiver connected to said motor controller;

wherein said receiver is adapted to receive control signals; and a remote transmitter adapted to send control signals to said receiver.

33. An apparatus as recited in claim 22, further comprising:

a motor enclosure coupled to said base plate adapted to enclose said motor;

a battery electrically connected to said motor; and a battery enclosure coupled to said base plate adapted to enclose said battery;

wherein said battery cannot be electrically disconnected from said motor when said motor is enclosed in said motor enclosure and said battery is enclosed in said battery enclosure.

34. An apparatus as recited in claim 22, wherein said means for limiting load comprises:

a tension arm having distal and proximal ends;

said proximal end of said tension arm coupled to said pinch roller;

said distal end of said tension arm adapted to move in a first direction;

wherein said pinch roller is adapted to reduce the grip on the rope when said distal end of said tension arm is moved in said first direction;

a load bracket having a pivot dowel, a support dowel and a load aperture, said load bracket coupled to said base plate at said pivot dowel; and a spring loaded support assembly coupled to said base plate;

said spring loaded support assembly adapted to support said load bracket at said support position;

wherein said spring loaded support assembly is adapted to react with said distal end of said tension arm when a load is supported in said load aperture in said load bracket; and wherein said spring loaded support assembly is adapted to move said distal end of said tension arm in said first direction causing said pinch roller to reduce the grip on the rope when the load supported in said load aperture exceeds a predetermined amount.

35. An apparatus as recited in claim 34, said spring loaded support assembly comprises:

a pivot bracket having a pivot end and a roller support platform, said pivot end coupled to said base plate;

a spring support clevis having a clevis fork and a support rod, said clevis fork coupled to said base plate;

wherein said spring support clevis is positioned under said roller support platform;

a spring retainer having a distal end and a proximal end, said distal end having a bore adapted to fit over said support rod;

said proximal end of said spring retainer having a flange adapted to fit under said roller support platform;

a compression spring adapted to fit between said support clevis and said flange of said spring retainer;

a slot in said roller support platform;

a platen coupled to said flange of said spring retainer;

wherein said platen is adapted to extend through said slot in said roller support platform; and a roller coupled to said support dowel of said load bracket;

wherein said roller is adapted to be supported on said platen when the load supported in said load aperture is less than or equal to said predetermined amount; and wherein said roller is adapted to react with said roller support bracket thereby moving said distal end of said tension arm in said first direction causing said pinch roller to reduce the grip on the rope when the load supported in said load aperture exceeds said predetermined amount.

36. An apparatus as recited in claim 35, wherein said roller support bracket is adjustable with respect to reaction with said distal end of said tension arm.

37. An apparatus for ascending a rope while supporting a load, comprising:

a base plate;

a load bracket coupled to said base plate;

said load bracket adapted to support a load;

a motor coupled to said base plate;

a rotating yoke coupled to said motor;

wherein said motor is adapted to rotate said rotating yoke;

a motion activated brake coupled to said rotating yoke;

a capstan drum coupled to said motion activated brake;

wherein said motion activated brake has a drive state and a brake state;

wherein said motion activated brake is in said drive state and rotates said capstan drum when said rotating yoke is rotating;

wherein said motion activated brake is in said brake state and prevents said capstan drum from rotating when said rotating yoke is stationary;

a pinch roller coupled to said base plate;

wherein said pinch roller is positioned to contact said capstan drum; and wherein said pinch roller is configured to apply a gripping force against at least one wrap of rope on said capstan drum.

38. An apparatus as recited in claim 37, further comprising:

a trigger coupled to said base plate;

said trigger having first and second positions;

a motor controller linked to said trigger;

said motor controller adapted to energize said motor;

wherein when said trigger is in said first position, said motor is not energized by said motor controller and said motion activated brake is in said brake state; and wherein when said trigger is in said second position, said motor is energized by said motor controller and said brake is in said drive state.

39. An apparatus as recited in claim 38, further comprising:

a receiver connected to said motor controller;

wherein said receiver is adapted to receive control signals to control said motor controller; and a remote transmitter adapted to send control signals to said receiver.

40. An apparatus as recited in claim 38, wherein said load bracket is adjustable with respect to reaction with said pinch roller.

41. An apparatus as recited in claim 37, further comprising:

a motor enclosure coupled to said base plate adapted to enclose said motor;

a battery electrically connected to said motor; and a battery enclosure coupled to said base plate adapted to enclose said battery;

wherein said battery cannot be electrically disconnected from said motor when said motor is enclosed in said motor enclosure and said battery is enclosed in said battery enclosure.

42. An apparatus as recited in claim 37:

wherein said load bracket is adapted to react with said pinch roller; and wherein said load bracket is configured to reduce the gripping force against said at least one wrap of rope on said capstan drum by said pinch roller when the load supported exceeds a predetermined amount.

* * * * *